US006755954B2

(12) United States Patent
Mayer et al.

(10) Patent No.: US 6,755,954 B2
(45) Date of Patent: Jun. 29, 2004

(54) ELECTROCHEMICAL TREATMENT OF INTEGRATED CIRCUIT SUBSTRATES USING CONCENTRIC ANODES AND VARIABLE FIELD SHAPING ELEMENTS

(75) Inventors: Steven T. Mayer, Lake Oswego, OR (US); Timothy Patrick Cleary, Portland, OR (US); Michael John Janicki, West Linn, OR (US); Edmund B. Minshall, Sherwood, OR (US); Thomas A. Ponnuswamy, Tulatin, OR (US)

(73) Assignee: Novellus Systems, Inc., San Jose, CA (US)

( * ) Notice: Subject to any disclaimer, the term of this patent is extended or adjusted under 35 U.S.C. 154(b) by 3 days.

(21) Appl. No.: 10/116,077

(22) Filed: Apr. 4, 2002

(65) Prior Publication Data

US 2002/0195352 A1 Dec. 26, 2002

Related U.S. Application Data

(63) Continuation-in-part of application No. 09/537,467, filed on Mar. 27, 2000, now Pat. No. 6,402,923

(60) Provisional application No. 60/302,111, filed on Jun. 28, 2001.

(51) Int. Cl.[7] ..... C25D 5/00

(52) U.S. Cl. ..... 205/96; 205/123; 205/125; 205/157; 204/224 R; 204/DIG. 7

(58) Field of Search ..... 204/224 R, DIG. 7; 205/96, 123, 125, 157

(56) References Cited

U.S. PATENT DOCUMENTS

| | | | | |
|---|---|---|---|---|
| 6,193,860 | B1 | 2/2001 | Weling | |
| 6,497,801 | B1 * | 12/2002 | Woodruff et al. | 204/230.2 |
| 2002/0000380 | A1 * | 1/2002 | Graham et al. | 205/102 |
| 2002/0008037 | A1 * | 1/2002 | Wilson et al. | 205/157 |

* cited by examiner

*Primary Examiner*—Wesley A. Nicolas
(74) *Attorney, Agent, or Firm*—Patton Boggs LLP

(57) ABSTRACT

An apparatus for electrochemical treatment of a substrate, in particular for electroplating an integrated circuit wafer. An apparatus preferably includes dynamically operable concentric anodes and dielectric shields in an electrochemical bath. Preferably, the bath height of an electrochemical bath, the substrate height, and the shape and positions of an insert shield and a diffuser shield are dynamically variable during electrochemical treatment operations. Step include varying anode current, bath height and substrate height, shield shape, and shield position.

37 Claims, 15 Drawing Sheets

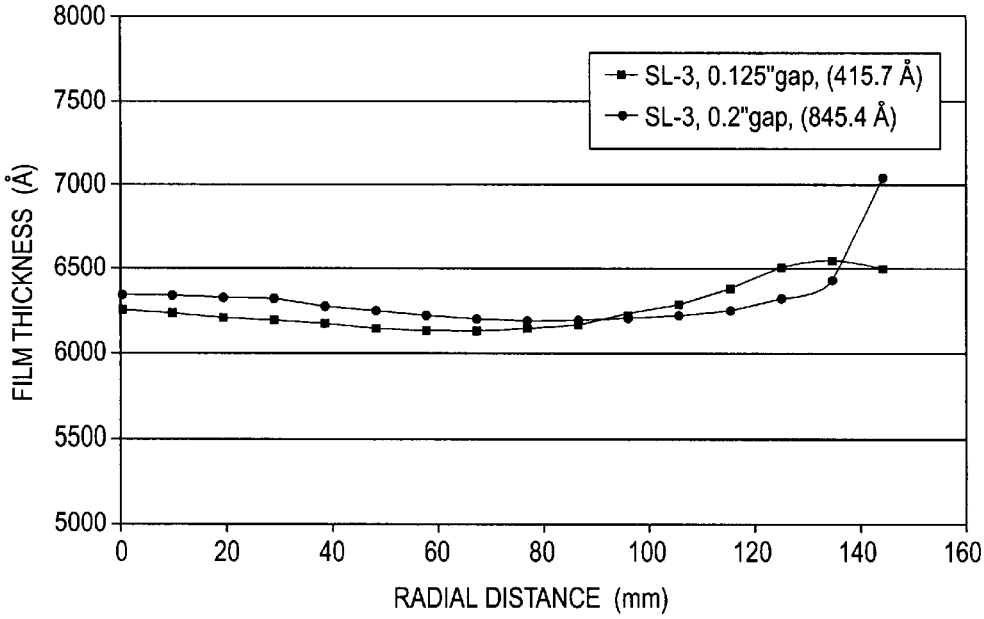
FIG. 15
FIG. 16
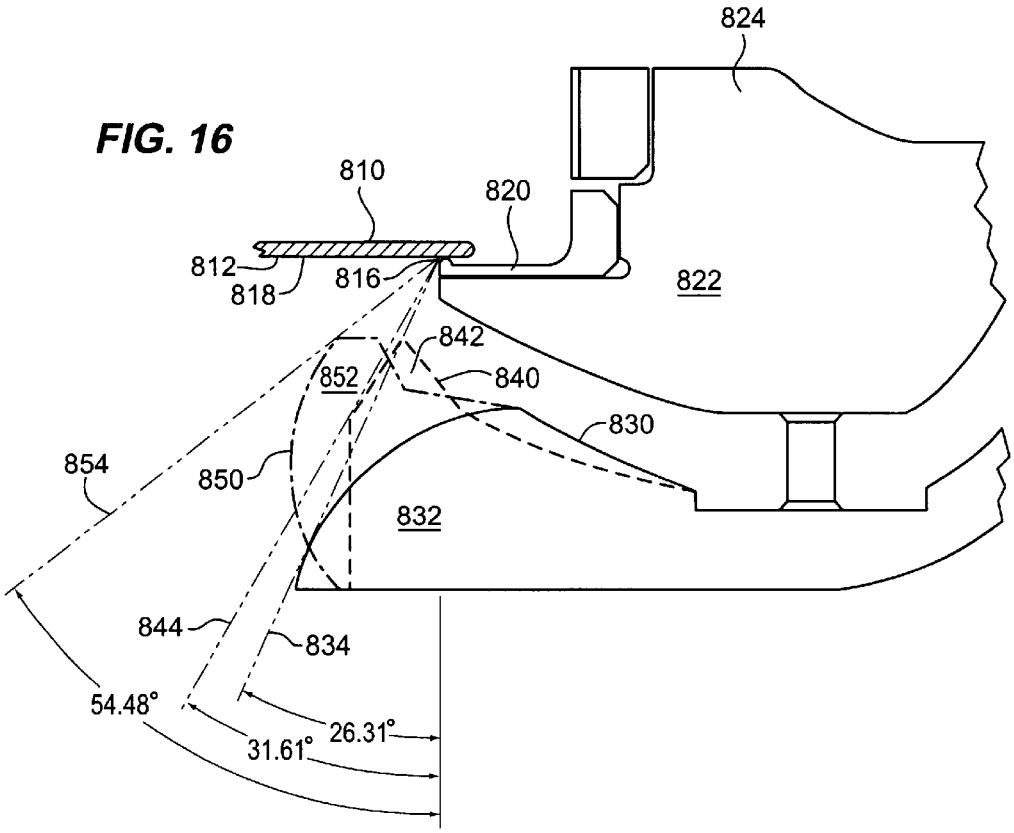

ELECTROCHEMICAL TREATMENT OF INTEGRATED CIRCUIT SUBSTRATES USING CONCENTRIC ANODES AND VARIABLE FIELD SHAPING ELEMENTS

RELATED APPLICATIONS

This application claims the benefit under 35 USC 119(e) of U.S. Provisional Application Serial No. 60/302,111, filed Jun. 28, 2001, which is incorporated herein by reference for all purposes. This application is also a continuation-in-part application of commonly-owned and copending U.S. patent application Ser. No. 09/537,467, filed Mar. 27, 2000, and now U.S. Pat. No. 6,402,923.

FIELD OF THE INVENTION

The present invention pertains to the field of reactors and methods for electrochemically treating integrated circuit substrates, and in particular, to the shaping of electric fields to control electric current density on substrates during electrochemical treatment.

BACKGROUND OF THE INVENTION

Statement of the Problem

A crucial component of integrated circuits is the wiring or metalization layer that interconnects the individual circuits. Wiring layers have traditionally been made of aluminum and a plurality of other metal layers that are compatible with the aluminum. In 1997, IBM introduced technology that facilitated a transition from aluminum to copper wiring layers. The transition from aluminum to copper required a change in process architecture (to damascene and dual-damascene), as well as a whole new set of process technologies. Copper damascene circuits are produced by initially forming trenches and other embedded features in a wafer, as needed for circuit architecture. These trenches and embedded features are formed by conventional photolithographic processes. Usually, a barrier layer, e.g., of tantalum or tantalum nitride, is formed on silicon oxide in the embedded features. Then, an initial "seed", or "strike", layer of copper about 1250 Å thick is deposited by a conventional vapor deposition technique. The seed layer should have good overall wafer uniformity, good step coverage (in particular, a continuous layer of metal deposited onto and conforming to the side-walls of an embedded structure), and minimal closure or "necking" of the top of the embedded feature. See, for example, "Factors Influencing Damascene Feature Fill Using Copper PVD and Electroplating", Reid, J. et al., *Solid State Technology*, July 2000, p. 86.

The seed layer is used as a base layer to conduct current for electroplating thicker films. In plating operations, the seed layer functions initially as the cathode of the electroplating cell to carry the electrical plating current from the edge zone of the wafer, where electrical contact is made, to the center of the wafer, including through embedded structures, trenches and vias. The final thicker film electrodeposited on the seed layer should completely fill the embedded structures, and it should have a uniform thickness across the surface of the wafer. Generally, in electroplating processes, the thickness profile of the deposited metal is controlled to be as uniform is possible. This uniform profile is advantageous in subsequent etch-back or polish removal steps.

Any change in conditions that increases the seed layer's resistivity or the seed layer's electrical path will exacerbate the difficulty of achieving a uniform current distribution, which is necessary for effective global electrofilling and uniformity. A number of industry trends, however, tend to increase the seed layer resistivity. These include 1) thinner seed layers, 2) larger diameter wafers, 3) increased pattern density and 4) increased feature aspect ratio ("AR"). Unfortunately, these trends produce challenging conditions for electrofilling, and are not generally amenable to maintaining uniform current density across a wafer. For example, for a given PVD seed deposition condition, smaller features are substantially more "necked" as compared to larger features. As the feature size shrinks, the fixed necking amount becomes relatively more restrictive of the etched feature opening. This effect causes the effective aspect ratio (that is, the AR of the feature into which the plating process must begin plating) of the smaller width features to be substantially higher than that of the original, unseeded etched feature. In order to minimize the necking effect, a thinner seed layer with more conformal side wall coverage is desirable. However, a thinner seed layer causes the initial current distribution across the wafer to become more non-uniform, which (if left uncompensated) leads to poor electrofilling uniformity across the wafer. The seed layer initially causes significant resistance radially from the edge to the center of the wafer because the seed layer is thin. This resistance causes a corresponding potential drop from the edge where electrical contact is made to the center of the wafer. Thus, the seed layer has a nonuniform initial potential that is more negative at the edge of the wafer. The associated deposition rate tends to be greater at the wafer edge relative to the interior of the wafer. This effect is known as the "terminal effect".

Thus, industry trends create a need for increasingly thinner seed layers having uniform thickness. It is anticipated that in the near future, seed-layer thickness will decrease to below 500 Å, and may eventually decrease to as little as 100 Å. Decreased seed layer thicknesses, combined with increased wafer diameters, however, require improvements in hardware and methods to maintain uniform electroplating.

Various studies have shown the importance of thin seed-layer properties, feature aspect ratio, and feature density on initial plating uniformity. U.S. Pat. No. 6,027,631, issued Feb. 22, 2000, to Broadbent et al., which is hereby incorporated by reference, teaches using asymmetrical shields to influence plating current.

U.S. Pat. No. 6,132,587, issued Oct. 17, 2000, to Jorne et al., teach various methods of mitigating the terminal effect and improving the uniformity of metal electroplating over the entire wafer, including increasing the resistance of the electrolyte, increasing the distance between the wafer and the anode, increasing the thickness of the seed layer, increasing the ionic resistance of a porous separator placed between the wafer and the anode, placement of a rotating distributor in front of the wafer, and establishing contacts at the center of the wafer. Jorne et al. disclose a "rotating distributor jet" that directs different amounts of flow to different radii of a wafer. Creating a spatially varying flowrate at the wafer to influence the global current distribution is practically difficult because the conditions of plating locally vary (flowrate, replenishment of additives, etc.) and, therefore, create a difficult-to-separate convolution between electrofilling and uniformity. Futhermore, no practical means of controlling plating conditions with respect to process time and film thickness was disclosed.

A general approach has been discussed of using a highly electrically resistive membrane placed in close proximity to the wafer so as to establish a "thin resistive plating" region where the potential drop across the wafer will be always smaller than the system potential drop. While this approach might work theoretically, in practice there are a number of problems. Firstly, placing the membrane close to the wafer is difficult (distance between membrane and wafer is typically about 1 cm or less for a typical copper acid plating bath having a conductivity of about 500 $ohm^{-1}$ $cm^{-1}$). Secondly, the potential drop and, therefore, the required power increase greatly. Also, establishing uniform flow to the wafer is difficult with a highly restrictive membrane so close to the wafer. That is, it is hard to decouple the fluid flow and the electric field problems because the membrane does not only resist current flow, but also resists fluid flow that needs to be directed at the wafer to replenish consumed reactants.

The ability to successfully electrofill (i.e. the ability to electroplate very small, high AR features without voids or seams) is dependent on a number of parameters. Among these are the 1) plating chemistry, 2) feature shape, width, depth, and density, 3) local seed layer thickness, 4) local seed layer coverage, and 5) local plating current. Items 3–5 are interrelated. As an example of this convolution, a decrease in seed-layer thickness can lead to greater potential differences between the center and edge of a wafer, and hence larger variations in current density during plating. Additionally, it is known that poor seed layer side-wall coverage leads to higher average resistivities for current traveling normal to the feature direction (for example, in trenches), also leading to large current density differences between the center and edge of a wafer. It has generally been observed (independent of plating chemistry) that effective electrofilling occurs only over a finite range of current densities. And while the appropriate electrofilling current density can depend on such things as feature shape, feature width or plating chemistry, for any given set of these parameters, there is typically a finite range of localized current density in which electrofilling can be successfully performed. Therefore, an apparatus and a method for plating at a uniform current density over a whole wafer are needed.

Another problem is the difficulty of achieving globally uniform electrodeposition and electrofilling in large diameter wafers. The industry has recently made a transition from 200 mm wafers to 300 mm wafers. Electrofilling generally requires that the current density increase proportionately with the wafer diameter. Thus, a 300 mm wafer requires 2¼ times more current than a 200 mm wafer. It has been shown that the resistance from the edge to the center of the wafer is independent of radius. See, Broadbent, E. K. et al., "Experimental and Analytical Study of Seed Layer Resistance for Copper Damascene Electroplating", *J. Vac. Sci. & Technol.* B17, 2584 (November/December 1999). With greater applied current at the edge (to maintain the same current density), the potential drop from the edge to the center of the wafer is correspondingly greater in a 300 mm wafer than in a 200 mm wafer. Therefore, there is a need for an apparatus and a method that compensate for the potential drop across the wafer, which changes during electroplating.

Defects at the very edge of electroplated wafers are common. Air bubbles, and to a much smaller extent particulates, often become trapped on the wafer surface, during the immersion of the face-down wafer. The defect-causing bubbles and other agents tend to form or accumulate at the edge of the wafer. Also, plating solution can become trapped in the region of the contacts seal. This can result in corrosion of the seed layer at the outer periphery of the wafer.

Therefore, it would be useful to have available an apparatus and method for electroplating a uniform, relatively thin layer of metal (for example, less than 7000 Å) on an integrated circuit wafer having a thin seed layer (for example, less than 500 Å) with no defects out to the periphery of the wafer (for example, within 2.5 mm of the wafer edge).

SUMMARY OF THE INVENTION

The invention helps to solve some of the problems mentioned above by providing systems and methods to achieve superior uniformity control and improved electrofilling of wafers having 1) thinner seed layers, 2) larger diameter (e.g. 300 mm instead of 200 mm), 3) higher feature densities, and 4) smaller feature sizes.

In one aspect of the invention, an apparatus for electrochemically treating the surface of a substrate comprises a plurality of dynamically operable concentric anodes opposite a substrate holder. In another aspect, a diffuser shield is located between the substrate holder and the concentric anodes. In another aspect, an insert shield is located between the diffuser shield and the substrate holder.

In aspect of the invention, an apparatus for electrochemically treating a surface of a substrate comprises a first bath container operably configured to retain an electrochemical bath at a bath height. In another aspect, a plurality of separately operable concentric anodes is disposed in the first bath container. In another aspect, a substrate holder is disposed in the first bath container opposite the concentric anodes at a substrate height. In still another aspect, a shield is disposed in the first bath container between the concentric anodes and the substrate holder, the shield operably configured for shielding a surface area of a substrate when a substrate is held in the substrate holder during electrochemical treatment operations. In another aspect, an embodiment in accordance with the invention includes a means, operable during electrochemical treatment operations, for dynamically varying a parameter selected from the group consisting of: a quantity of shielded surface area of a substrate, a distance separating the shield from the substrate holder, a distance separating the substrate holder from the concentric anodes, and combinations thereof. Another aspect is a variable weir assembly for dynamically varying the bath height and an actuator for dynamically moving the substrate holder, to vary dynamically the substrate height. In still another aspect, the first bath container has a first overflow height, and a second bath container surrounds the first bath container and has a second overflow height higher than the first overflow height, and a third, overflow container surrounds the second bath container. Another aspect of the invention is a first valve for maintaining an electrochemical bath at the first overflow height, and a second valve for maintaining an electrochemical bath at the second overflow height. In another aspect, an apparatus includes a movable sluice gate in the bath container wall for controlling the bath height. In still another aspect, the shield is a diffuser shield located between the concentric anodes and the substrate holder. In another aspect, the diffuser shield comprises a plurality of rings rotatable about a common axis, each of the rings configured to have an open area and a closed area. In another aspect, an embodiment in accordance with the invention includes an actuator for dynamically rotating one of the rings to vary the open and closed areas and, thereby, a quantity of shielded surface area of a substrate. In another aspect, the shield is an insert shield located between the anode and the substrate holder. In another aspect, the insert shield is separated from the substrate holder by a flow gap. Another aspect is a movable spacer for attaching the insert shield to the substrate holder and an actuator for moving the spacer to vary dynamically the flow gap. In another aspect, an apparatus further includes means for rotating the substrate holder.

In another aspect, a diffuser shield has an inside lip diameter in a range of about from 8 inches to 12 inches. In still another aspect, the diffuser shield is a beta-type diffuser shield having wedge-shaped open areas in an annular lip. In another aspect, an insert shield has an inside diameter in a range of about from 10.5 to 12 inches. In another aspect, the insert shield and the substrate holder form a flow gap having a width in a range of about from 0.075 to 0.3 inches. In another aspect, the insert shield has a streamline-type rim portion. In still another aspect, the insert shield has a modified streamline-type rim portion having a radius of curvature in a range of about from 1/16 to one-half inch.

In one aspect of the invention, a method for electrochemically treating the surface of a substrate comprises steps of providing an electrochemical bath with an anode located at the bottom of the electrochemical bath, placing a wafer substrate in the substrate holder, and then immersing the wafer substrate held in the substrate holder into the electrochemical bath opposite the anode. In another aspect, a method includes a further step, prior to the step of immersing, selected from the group consisting of: pre-washing an electrical contact in the substrate holder, and pre-wetting the wafer substrate. A further aspect is a step of rotating the wafer substrate.

In another aspect, a method for electrochemically treating the surface of a substrate comprises steps of immersing the wafer substrate into the electrochemical bath at a substrate height and opposite the concentric anodes. Another aspect is a step of providing a diffuser shield located between the wafer substrate and the concentric anodes. Another aspect is a step of providing an insert shield located between the diffuser shield and the wafer substrate. Another aspect of the invention is dynamically varying the power delivered to the concentric anodes. Another aspect is a step of dynamically varying the flow gap between the insert shield and the substrate holder. In another aspect, an embodiment in accordance with the invention comprises a step of dynamically varying a closed area of the diffuser shield. In still another aspect, an embodiment comprises steps of dynamically varying the bath height, and dynamically varying the substrate height.

In one aspect, a method for electrochemically treating a surface of a substrate comprises steps of dynamically varying a parameter selected from the group consisting of a quantity of shielded surface area of the substrate, a distance separating the shield from the substrate, a distance separating the substrate from the concentric anodes, and combinations thereof. In a further aspect, embodiment comprises steps of dynamically varying the bath height in the first bath container, and dynamically moving the substrate holder, to vary dynamically the substrate height. In another aspect, a method comprises steps of substantially closing a first outlet valve so that electrochemical fluid substantially fills a second bath container, thereby generating a second bath height, and controlling a second valve in a third container to maintain the second bath height. In another aspect, an embodiment comprises steps of dynamically moving the substrate holder to vary the substrate height, thereby actuating a movable sluice gate in a bath container wall for controlling the bath height. In another aspect, the shield is a diffuser shield comprising a plurality of rings rotatable about a common axis, each of the rings configured to have an open area and a closed area, and the diffuser shield is located between the concentric anodes and the substrate holder, and a method further comprises dynamically rotating one of the rings to vary a quantity of shielded surface area of a substrate. In another aspect, the shield is an insert shield attached to the substrate holder by a movable spacer and located between the anode and the substrate holder, and a method further comprises steps of actuating the movable spacer to vary dynamically a flow gap between the insert shield and the substrate holder.

In addition to being useful in a wide variety of electroplating operations, embodiments in accordance with the invention are generally useful in numerous types of electrochemical operations, especially during manufacture of integrated circuits. For example, embodiments are useful in various electrochemical removal processes, such as electroetching, electropolishing, and mixed electroless/electroremoval processing.

Embodiments in accordance with the invention are described below mainly with reference to apparati and methods for electroplating substrate wafers. Nevertheless, the terms "electrochemical treatment", "electrochemically treating" and related terms as used herein refer generally to various techniques, including electroplating operations, of treating the surface of a substrate in which the substrate or a thin film of conductive material on the substrate functions as an electrode.

The terms "dynamic", "dynamically varied" and similar terms herein mean that a variable or parameter of an apparatus or method is selectively changed during the treatment of a wafer. In particular, a variable or parameter is dynamically varied to accommodate the changing electrical properties of a deposited metal layer as layer thickness increases (or decreases in layer removal treatments) during electrochemical treatment operations. The term "time-variable" and similar terms are used more or less synonymously with terms such as "dynamic".

The term "dynamically operable" used with reference to a device generally means that the function or operations of the device can be selectively changed during electrochemical treatment of a particular substrate. The terms "dynamically operable", "separately operable" and similar terms used with specific reference to concentric anodes are used in two senses. In one general sense, the terms mean that one or more concentric anodes of a plurality of concentric anodes in a given electrochemical treatment apparatus can be controlled in a circuit including a power supply and a cathodic wafer substrate separately and independently from other concentric anodes. In a second general sense, the terms mean that two or more concentric anodes of a plurality of concentric anodes are connected in parallel to a power supply, and the total power delivered by the power supply can be selectively distributed between the connected concentric anodes.

BRIEF DESCRIPTION OF THE DRAWINGS

A more complete understanding of the invention may be obtained by reference to the drawings, in which:

FIG. 15 contains a graph presenting exemplary data to compare the effect in accordance with the invention of flow-gap width on plating thickness;

FIG. 16 depicts schematically the angle, θ, of lines intersecting the seal/substrate interface point tangent to the rim portion of insert shields in accordance with the invention;

DESCRIPTION OF THE INVENTION

Figure 1:
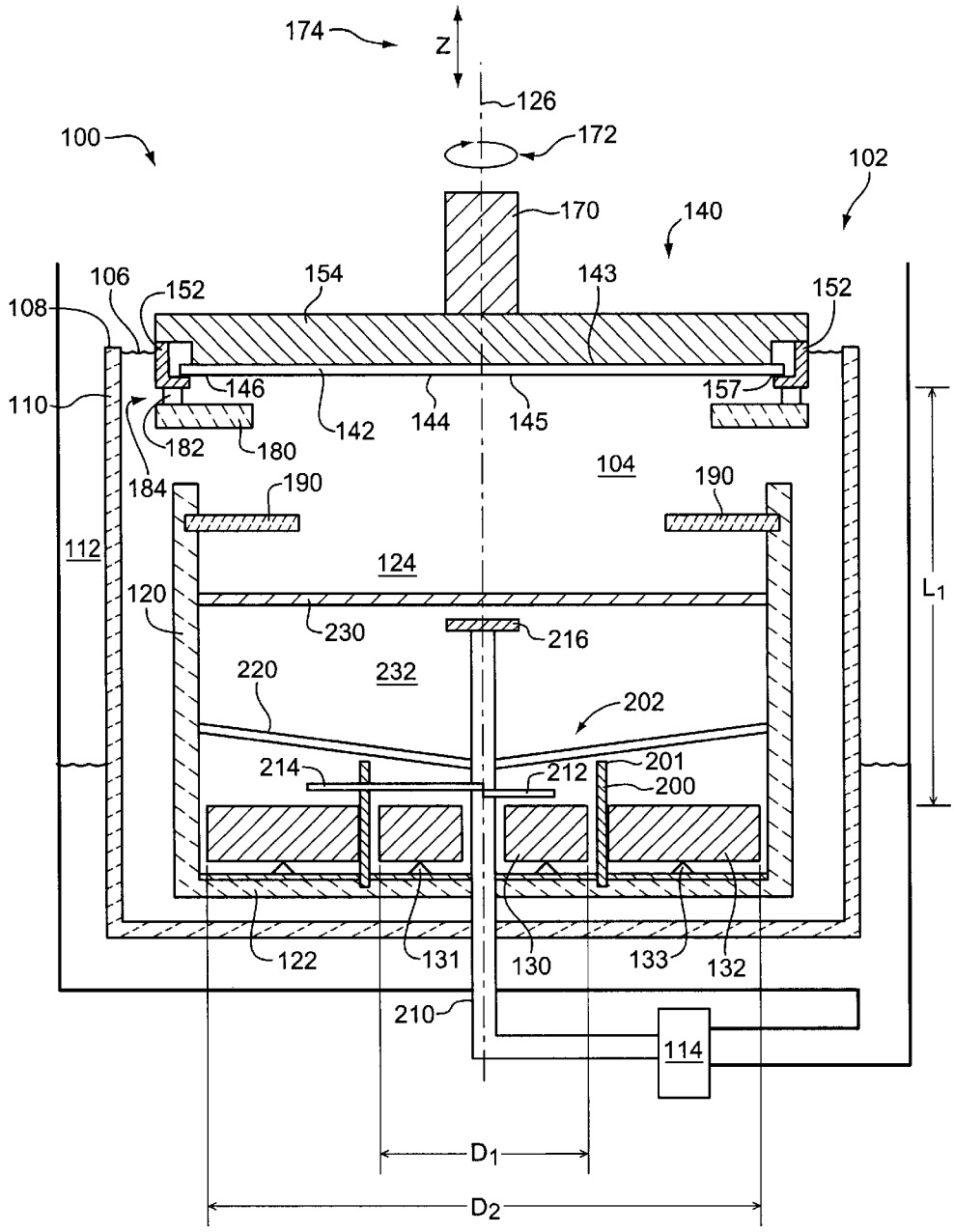
FIG. 1 depicts in schematic form an apparatus in accordance with the invention.

Overview.

The invention is described herein with reference to FIGS. 1–31. It should be understood that the structures and systems depicted in schematic form in FIGS. 1–31 are used to explain the invention and are not precise depictions of actual structures and systems in accordance with the invention. Furthermore, the preferred embodiments described herein are exemplary and are not intended to limit the scope of the invention, which is defined in the claims below.

Embodiments in accordance with the invention compensate for electrical resistance and voltage drop across the wafer, particularly at the beginning of an electroplating process when the thin seed layer dominates current flow and voltage drop. Such compensation is generally conducted by shaping a potential drop in the electrolyte bath corresponding, but inverse, to the electrical resistance and voltage drop across the wafer substrate, thereby achieving a uniform (or tailored, if desired) current distribution. As the electroplated layer becomes thicker and the terminal effect decreases, preferred embodiments in accordance with the invention effect a transition to a uniform plating distribution by dynamically varying the electrical field and current source that the wafer experiences.

Commonly-owned U.S. Pat. No. 6,162,344, issued Dec. 19, 2000, to Reid et al., which is hereby incorporated by reference, teaches using shields between an anode and a wafer to reduce mass transfer of the electroplating solution near the edge of the wafer to compensate the terminal effect and to improve thickness uniformity of electroplated material.

Co-pending and commonly-owned U.S. application Ser. No. 09/537,467, filed Mar. 27, 2000, now U.S. Pat No. 6,403,923, which is hereby incorporated by reference, teaches an electrochemical reactor having a variable field-shaping capability for use in electroplating thin films, comprising a shield positioned between the cathode and the anode. The shield is configured for varying a quantity of shield surface area of a wafer or a distance separating the shield from the wafer, or both, during electroplating operations. Varying the shield surface area or the distance between the shield and wafer is useful for compensating the changing electrical resistance between wafer edge and center during electroplating. Compensating the changing electrical resistance increases uniformity of thickness electroplated material on the wafer. Co-pending and commonly-owned U.S. application Ser. No. 09/542,890, filed Apr. 4, 2000, now U.S. Pat. No. 6,514,393, which is hereby incorporated by reference, teaches a flange for holding a wafer substrate and that has a bladder that can be inflated and deflated to effect variable shielding of the wafer surface.

An apparatus and a method in accordance with the present invention provide improvements for varying the distance separating a shield from the wafer during an electrochemical treatment and for varying the distance between an anode and the wafer. Embodiments in accordance with the invention further provide improved shields and improved varying of shielded surface area during electroplating and other electrochemical treatments.

Commonly-owned U.S. Pat. No. 6,179,983, issued Jan. 30, 2001, to Reid et al., which is hereby incorporated by reference, teaches an electroplating apparatus comprising a virtual anode located between the actual anode and the wafer. The virtual anode contains openings through which electrical current flux passes. Selection of the radius or length, or both, of the openings allows modification of the thickness profile of the electroplated material.

Embodiments in accordance with the invention are useful for focusing current to a wafer center. Certain embodiments include the combination of multiple concentric segmented anodes (hereinafter, "concentric anodes" or "ConAn") and a dielectric (e.g., plastic or ceramic) field shaping and focusing element. Alternatively, a field shaping element may be constructed from a metal completely resistant to plating. For example, in the case of copper plating, Ta, W and Ti are suitable shield materials. Concentric anodes in accordance with the present invention provide multiple anode segments to improve modification of the current flux and, thereby, the thickness profile. Preferred embodiments provide for dynamically varying the current from one or a plurality of concentric anodes to achieve desired current flux.

Embodiments in accordance with the invention utilize current-blocking, field-shaping elements (hereinafter "field-shaping elements" or "shields"), the effect of which is spatially distributed on the wafer over time due to rotation of the cathode wafer substrate over the elements. Preferably, the shape and/or location of a field-shaping element is dynamically varied during surface treatment of the substrate. In addition, multiple time-variable electric-current sources (concentric anodes) generate a spatially dependent, preferably time-variable, current flux to the wafer surface. Moving or changing the shape of a field-shaping element, moving the wafer with respect to a field-shaping element or an anode, varying the amount of current from a one or more concentric anodes, or a combination of these, enables variable time-dependent "focusing" of current as an electrochemical treatment process progresses. This allows "dynamic", or time-varying, compensation of the overall electrical resistance between the wafer edge and the wafer center, thereby obtaining desired properties of a treated substrate. Thus, preferred embodiments in accordance with the invention include the combination of time-varied multiple concentric anodes together with time-averaged and time-varied shielding to provide simple, low cost, reliable production of uniform electroplated films on integrated circuit wafers having a very thin metal seed layer.

Another problem that the current invention solves is that associated with edge defects. A preferred method in accordance with the invention includes a step of rinsing electrical contacts in the substrate holder before mounting a wafer in it, or a wetting operation that pre-wets a dry wafer before its placement in the substrate holder and its immersion in an electrochemical bath, or both.

The disclosed devices and methods are not limited in use to a particular electrochemical tool design or process chemistry, although preferred embodiments are disclosed herein. The focusing element(s) and anode chamber should be made of materials that are substantially resistant to corrosion or attack from the particular electrochemical treating solution being used.

DETAILED DESCRIPTION OF PREFERRED EMBODIMENTS

FIG. 1 depicts in schematic form an apparatus 100 in accordance with the invention. A first, main plating bath container 102 contains a conventional electroplating bath 104 comprising electrolytic plating fluid. First cylindrical container wall 110 having a top 108 determines plating bath height 106 when plating bath 104 completely fills first plating bath container 102. Container wall 110 functions as an overflow weir. During typical operation, plating fluid overflows weir 110 into a second container 112, concentric with main plating bath container 102 and plating bath 104, where it is collected and processed by central bath control 114, as in current Saber XT models, commercially available from Novellus Systems, Inc., San Jose, Calif. In this manner, bath height 106 is maintained.

Cylindrical anode chamber wall 120 and anode chamber bottom 122 define the sides and bottom of anode chamber 124. Anode chamber wall 120 and bottom 122 are constructed essentially with electrically insulating material, such as a dielectric plastic. Anode chamber 124 is substantially centered about the geometric central axis of apparatus 100, indicated by dashed line 126. Inner concentric anode 130 is located at the bottom of anode chamber 124, substantially centered about central axis 126. Inner concentric anode 130 is substantially disk-shaped with a central hole. In an electroplating apparatus designed for 300 mm wafers, inner concentric anode 130 has a thickness in its axial direction in a range of about 35 mm and an outside diameter, $D_1$, of about 127 mm. Inner concentric anode 130 is supported on the bottom of anode chamber 124 by electrically-conductive inner anode connector 131. Outer concentric anode 132 is located at the bottom of anode chamber 124, concentric with inner anode 130 about central axis 126. Outer concentric anode 130 has an outside diameter, $D_2$, of about 300 mm and an axial thickness similar to the thickness of inner concentric anode 130. Outer concentric anode 132 is supported on the bottom of anode chamber 124 by electrically-conductive outer anode connector 133. Each of anode connectors 131, 133 is separately connected (or both are connected in parallel) to a positive terminal of a power supply (not shown). This allows separate control of electrical current and power to each of concentric anodes 130,132.

Electroplating bath 104 is a conventional bath that typically contains the metal to be plated together with associated anions in an acidic solution. Copper electroplating is usually performed using a solution of CuSO4 dissolved in an aqueous solution of sulfuric acid. In addition to these major constituents of the electroplating bath 104, it is common for the bath to contain several additives, which are any type of compound added to the plating bath to change the plating behavior. These additives are typically, but not exclusively, organic compounds that are added in low concentrations ranging from 20 ppm to 400 ppm.

Three types of electroplating bath additives are in common use, subject to design choice by those skilled in the art. Suppressor additives retard the plating reaction and increase the polarization of the cell. Typical suppressors are large molecules having a polar center and they strongly adsorb to copper; for example, a surfactant. These molecules increase the surface polarization layer and prevent copper ion from readily adsorbing onto the surface. Thus, suppressors function as blockers. Suppressors cause the resistance of the surface to be higher than in their absence. Trace levels of chloride ion may be required for suppressors to be effective. Examples of suppressors include various formulations of polyethylene oxides having various molecular weights and co-polymers.

Accelerator additives are normally catalysts that accelerate the plating reaction under suppression influence or control. Accelerators may be rather small molecules that often contain sulfur, and they need not be ionic. Examples of accelerators include mercapto propane sulfonic acid (MPS) and di-mercapto propane sulfonic acid (SPS). Accelerators adsorb onto the surface and increase the flow of current. Accelerators may occur not as the species directly added to the electroplating bath, but as breakdown products of such molecules. In either case, the net effect of accelerators is to increase current flow and accelerate the reaction. Levelers behave like suppressors, but are highly electrochemically active (i.e., are more easily electrochemically transformed), losing their suppressive character upon electrochemical reaction. Levelers also tend to accelerate plating on depressed regions of the surface undergoing plating, thus, tending to level the plated surface.

Figure 2:
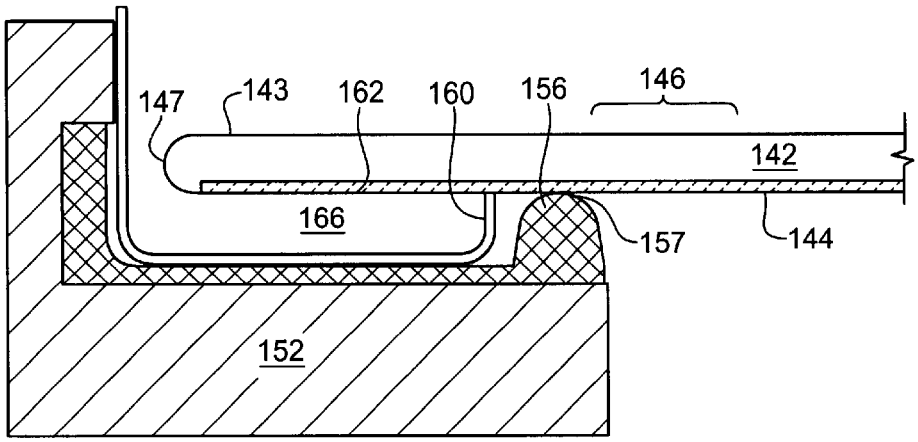
FIG. 2 depicts in schematic form the disposition of wafer substrate in a cup of a clamshell substrate holder.

Electroplating apparatus 100 further includes a substrate wafer holder 140. Substrate holder 140 holds integrated circuit substrate wafer 142. Wafer 142 has a wafer backside 143 and a front plating surface 144, typically containing a conductive seed layer, which front surface 144 is treated in accordance with the invention. Substrate wafer 142 and front surface 144 have a center zone 145 and an edge zone 146 near the outside edge 147 of the wafer. Preferably, substrate holder 140 is a clamshell-type wafer holder, as described in commonly-owned U.S. Pat. No. 6,156,167, issued Dec. 5, 2000 to Patton et al., which is hereby incorporated by reference. Clamshell substrate holder 140 as depicted in FIG. 1 comprises a cup 152 and a cone 154. Cup 152 contains a cavity into which wafer substrate 142 is placed. Cup 152 also contains a compliant O-ring seal and a set of electrical contacts for electrically connecting the negative terminal of a power source to the conductive seed layer at the edge of wafer substrate 142. FIG. 2 depicts in schematic form the disposition of wafer substrate 142 in cup 152 of a clamshell substrate holder 140. Cup 152 is fitted with a compliant seal 156, which forms a seal at wafer/seal interface 157 between cup 152 and plating surface 144. Electrical contacts 160 make electrical connection with seed layer 162 near wafer substrate edge 147. By forming a seal between cup 152 and plating surface 144 in edge zone 146 of plating surface 144, compliant seal 156 prevents the plating fluid from entering a dry region 166 of cup 152 and contaminating contacts 160, the dry wafer periphery at edge 147 and wafer backside 143. In this specification, the terms "dry", "unexposed" and similar terms generally refer to the part of wafer edge 147 not exposed to plating bath during electroplating operations. Cone 154 (FIG. 1) is lowered and pressed onto cup 152 after wafer 142 is in place. Cup 152 and cone 154 are clamped together by pulling a vacuum between them. Cone 154 is attached to rotatable spindle 170. A motor (not shown) drives spindle 170. This provides rotation of substrate holder 140 and wafer substrate 142 around central axis 126, as indicated by rotation arrow 172. The distance between concentric anodes 130,132 and plating surface 144 defines a substrate height $L_1$. Substrate holder 140 is partially submerged in plating bath 104 during electroplating operations so that electrolytic plating fluid wets plating surface 144 of substrate 142, but does not wet the upper portions of substrate holder 140. Preferred embodiments in accordance with the invention also provide dynamic translation of wafer holder 140 up or down in the z-direction indicated by arrows 174 during electroplating operations to vary dynamically substrate height $L_1$.

As depicted in FIG. 1, preferred embodiments in accordance with the invention include an insert shield 180 between anode chamber 124 and wafer substrate 142 for shielding edge zone 146 of substrate 142. Typically, insert shield 180 is supported by cup 152 and is attached to cup 152 by spacers 182. Insert shield 180 and substrate holder 140 define a flow gap 184 through which plating fluid passes. As explained below, the size and shape of the insert shield 180 and the size and shape of flow gap 184 influence the flow pattern and current flux through the electrolyte to edge zone 146 during electrochemical treatment of substrate 142. Preferably, spacers 182 are variable during electroplating operations for dynamically varying flow gap 184.

Figure 6:
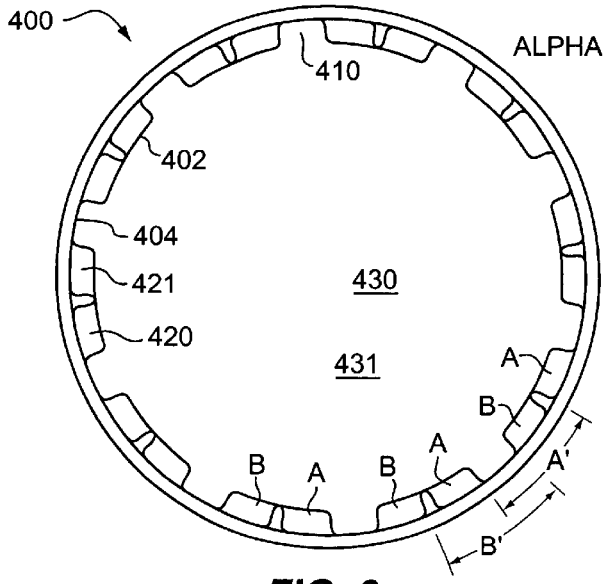
FIG. 6 depicts an alpha-type diffuser shield in accordance with the invention constructed using two rotatable rings with overlapping open and closed areas.

Preferred embodiments in accordance with the invention further include a diffuser shield 190 located between concentric anodes 130, 132 and substrate 142. Preferably, diffuser shield 190 is located in anode chamber 124. Typically, diffuser shield 190 has a substantially annular shape. As depicted in the embodiments of FIG. 1, diffuser shield 190 is supported in anode chamber wall 120. Preferably, the shielding area of a diffuser shield is dynamically variable during electroplating operations (or other electrochemical treatment) on substrate 142. As depicted in FIG. 6, a diffuser shield in accordance with certain embodiments of the invention comprises a plurality of annular rings rotatable about central axis. Each of the rings is configured to have an open area and a closed area. Rotation of one or more rings relative to the other rings changes the degree of overlapping of the respective open areas and closed areas of the rings. As a result, the shielding surface area of the shield is changed. Therefore, an apparatus 100 in accordance with the invention preferably includes an actuator (not shown) for dynamically rotating at least one of the rotatable rings of a diffuser shield during electroplating operations.

Wafer 142 may be any semiconducting or dielectric wafer, such as silicon, silicon-germanium, ruby, quartz, sapphire, and gallium arsenide. Prior to electroplating, wafer 142 is preferably a silicon wafer having a copper seed layer on a Ta or TiN barrier layer.

Insert shield 180, diffuser shield 190, inner wall 200 and anode container wall 120 comprise materials that resist attack by electrolytic plating fluid in bath 104. These materials are preferably high dielectrics or a composite material including a coating of a high dielectric to prevent electroplating of metal onto the shields or walls due to the induced variation in potential depending on their positions within the bath. For example, various plastics may be used, including polypropylene, polyethylene, and fluoro-polymers, especially polyvinylidine fluoride, or ceramics such as alumina or zirconia.

As shown in FIG. 1, preferred embodiments of apparatus 100 further comprise a dielectric inner focusing wall 200 located between inner concentric anode 130 and outer concentric anode 132, and having a wall height 201. Inner focusing wall 200 defines inner focusing cylinder 202, having an inner focusing cylinder height defined by wall height 201. Inner focusing cylinder 202 functions to focus the current flux from inner concentric anode 130 towards the center of wafer substrate 142 during electroplating operations (or other electrochemical treatment). Similarly, inner focusing wall 200 and anode chamber wall 120 influence the current flux from outer concentric anode 132 and focus it towards substrate 142.

For example, a decrease in the diameter of anode chamber wall 120 or an increase in substrate height $L_1$ lead to greater resistance for electroplating current to pass from the anode through electrolyte plating bath 104 to wafer edge 146. In particular embodiments in accordance with the invention, the various dimensions, such as $D_1$, $D_2$, and $L_1$, are selected and optimized according to various factors, including, for example: plating bath factors, such as conductivity and reactive properties of its organic additives; the initial seed thickness and profile; and damascene feature density and aspect ratios.

As depicted in FIG. 1, inlet manifold 210 carries plating fluid into anode chamber 124. Plating fluid flows through inlet flutes 212 to irrigate inner anode focusing cylinder 202 and inner concentric anode 130. Plating fluid also flows through inlet flutes 214 to irrigate outer concentric anode 132. Plating fluid also flows into anode chamber 124 through top hatless inlet nozzle 216 located at the end of inlet manifold 210. In preferred embodiments, a porous anode membrane 220 is disposed in anode chamber 124 above concentric anodes 130, 132. Anode membrane 220 is substantially resistive to flow and serves to distribute the flow of electrolytic plating fluid. In preferred embodiments, the height 201 of inner anode focusing wall 200 is slightly lower (2–3 mm) than anode membrane 210. A preferred embodiment further includes porous flow distribution membrane 230 located above nozzle 216. Anode membrane 220 and flow distribution membrane 230 define a diffuser subchamber 232. Plating fluid flows into flow distribution subchamber 232 through inlet nozzle 216, which substantially redirects fluid flow from an axial to a radial direction with respect to center axis 126. Substantially all of the plating fluid that enters flow distribution chamber 232 flows out of chamber 232 through porous flow distribution membrane 230, which creates substantially azimuthally uniform flow of plating fluid directed at wafer substrate 142 above.

Table 1 presents exemplary ranges of total anodic current and current distribution between inner and outer concentric anodes in preferred electroplating methods in accordance with the invention in which the plating bath contains an electrolytic plating fluid having a typical conductivity of about 500 mS/cm.

TABLE 1

Electroplating with Concentric Anodes

| Step | Anodic Current | Ratio of Current, Inner/Outer Anode | Time Range (seconds) |
|---|---|---|---|
| 1. | from about 1 to 2 amps | from about 80.20 to 100:0 | from about 10 to 30 s |
| 2. | from about 5 to 8 amps | from about 80:20 to 100:0 | from about 10 to 30 s |
| 3. | from about 15 to 20 amps | from about 75:25 to 80:20 | from about 15 to 25 s |
| 4. | from about 30 to 35 amps | from about 75:25 to 80:20 | from about 15 to 20 s |

Because the thickness (and hence the electrical resistance) of the seed layer together with the deposited electroplated metal film substantially changes during a plating operation, it is preferred to vary dynamically combinations of applied current and shield-shape, -size, and position during an electroplating process to maintain a uniform current distribution at all times throughout the plating process.

EXAMPLE 1

Figure 3:
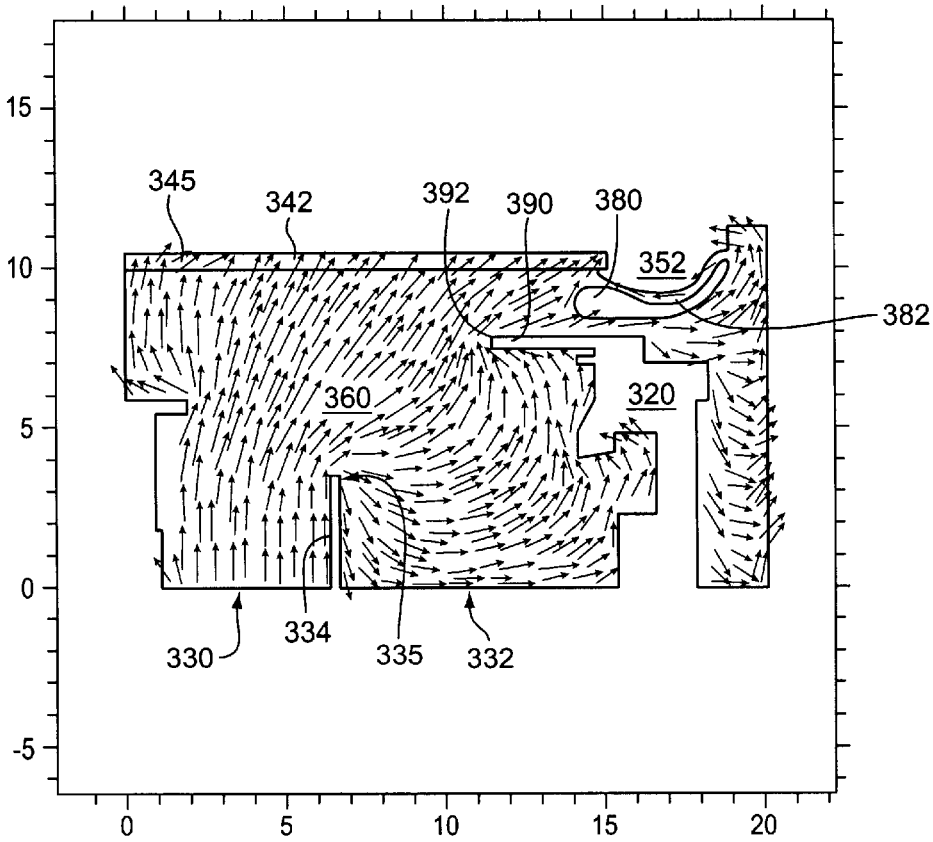
FIG. 3 depicts schematically the results of a calculation by a mathematical model simulating the influence of three field shaping elements in accordance with the invention on electrical current flux distribution in an electroplating apparatus.

FIG. 3 depicts schematically the results of a calculation by a mathematical model simulating the influence of three field-shaping elements on current flux distribution in an electroplating apparatus designed for a 300 mm wafer. Important elements of the model were: inner concentric anode 330, outer concentric anode 332 (each of which anodes can be powered separately); diffuser shield 390; and insert shield 380. In the model, wafer substrate 342 was located about 4.0 inches above concentric anodes 330, 332. Diffuser shield 390 is depicted vertically fixed to an anode chamber wall 320. Diffuser shield 390 had an inside diameter 392 of 9.0 inches. Diffuser shield was located about 1.0 inch below wafer substrate 342. In the model, modified streamline-shaped insert shield 380 was fixed to cup 352 of a clamshell-type substrate holder. Insert shield 380 and cup 352 defined a flow gap 382 having a width of 0.1 inch. The model simulated all current coming from inner concentric anode 330, and no current from outer anode 332. Inner anode focusing wall 334 had a vertical height 335 of about 1.5 inches above concentric anodes 330, 332. Plating bath 360 was modeled to have a conductivity of 500 $ohm^{-1}$ $cm^{-1}$. The simulation represents a so-called primary terminal-current distribution, and it included the effect of the electrical resistances in the bath and in the thin seed layer (500 Å seed layer with assumed 2×10−6 ohm cm resistivity). When a metal film is thin (~<1200 Å), and if no field-shaping is conducted in accordance with the invention, plating at the center of a wafer substrate is quite small, and plating occurs preferentially at the very edge of the wafer. The simulated results depicted in FIG. 3 illustrate, however, a focusing of current flux substantially to the center zone 345 of wafer of 342. As a result, electroplating of metal from plating solution shifts toward center zone 345.

Figure 4:
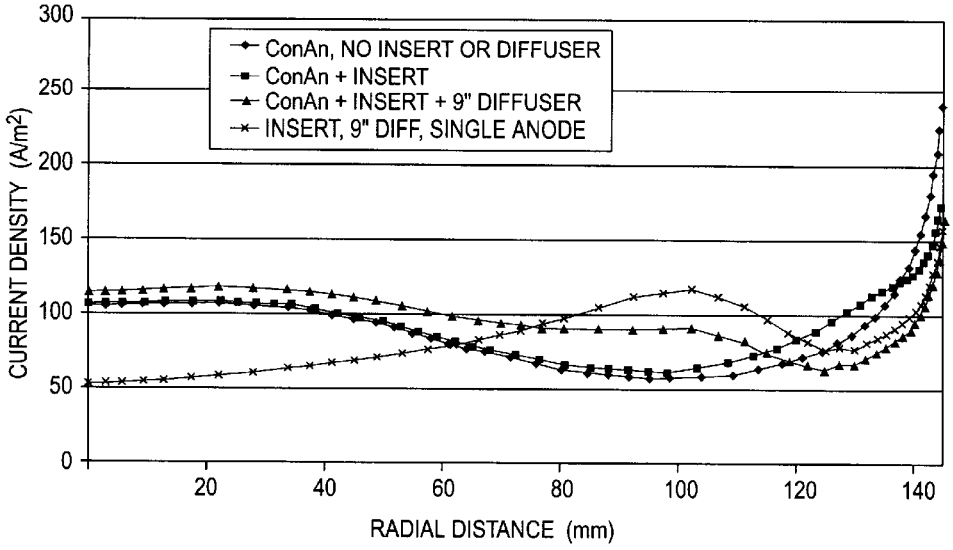
FIG. 4 includes a graph in which are plotted the results of calculations to compare the relative effects of field-shaping elements in accordance with the invention on current density distribution.

Results of calculations using models to compare the relative effects of field-shaping elements in accordance with the invention are plotted in the graph of FIG. 4. The diamond-shaped symbols in FIG. 4 show that focusing of current with inner concentric anode provides high current density at the center zone of a wafer. Nevertheless, a trough ("ringing effect") occurs in the middle zone around 100 to 140 mm, and the edge current (>135 mm) is relatively large because a 5-inch inner concentric anode can only direct current towards the wafer center, out to about 90–100 mm. Changing the inner core diameter changes the shape of the thickness curves' "ring" (e.g., center has a large hump), but does not alter generally the shape of the curves. Addition of an insert shield to the model together with an inner anode, represented by square-shaped symbols, causes some of the current at the extreme edge (>135 mm) to shift away towards the middle zone, but it is less effectual in blocking and redistributing current to the wafer mid-section (65 to 135 mm) and flattening the profile there. Calculations including an inner anode, an insert shield and a 9-inch diffuser shield (i.e., 9-inch diameter circular open area), represented by triangles in FIG. 4, show lower extreme edge current, but a deep trough (ringing effect) shifted into the edge zone around 130 mm. On the other hand, a model including a single conventionally-sized anode, an insert shield and a 9-inch diffuser shield indicates low current flux in the center zone and high current flux in the middle zone about 100 mm.

Therefore, while the elements in the simulation were not optimized to achieve an ideal flat profile, the effect of these different elements and the range of wafer radii over which they affect the current distribution was demonstrated.

A series of electroplating operations in accordance with the invention were conducted to deposit copper layers on integrated circuit wafer substrates having copper seed layers and diameters of 300 mm. When a diffuser shield was used, it was located at the top of the anode chamber, about 1.0 inch from the substrate plating surface. The electroplating operations were performed in a model Sabre XT electroplating cell manufactured by Novellus Systems, Inc., San Jose, Calif., modified in accordance with the invention. Operating variables were substantially similar to those disclosed in "Factors Influencing Damascene Feature Fill Using Copper PVD and Electroplating", Reid, J. et al., *Solid State*

*Technology*, July 2000, p. 86. The total current applied at any given time during electroplating was distributed between the inner and outer concentric anodes in accordance with the values presented in Table 1. The total current applied at any given time to an inner concentric anode, an outer concentric anode, or to both simultaneously was substantially the same level that would have been applied to a conventionally-sized single anode. In accordance with the invention, wafer holders were rotated so that wafer substrates and their plating surfaces had a rotational speed of approximately 90 rpm during electroplating operations. Unless otherwise indicated, substrate wafers had an initial copper seed-layer thickness of approximately 400 Å. Point scans were made at numerous azimuthal locations at the same radial distance and averaged to obtain thickness measurements of a plated layer for a given radial distance. Measurements and results are presented in the following examples.

EXAMPLE 2

Figure 5:
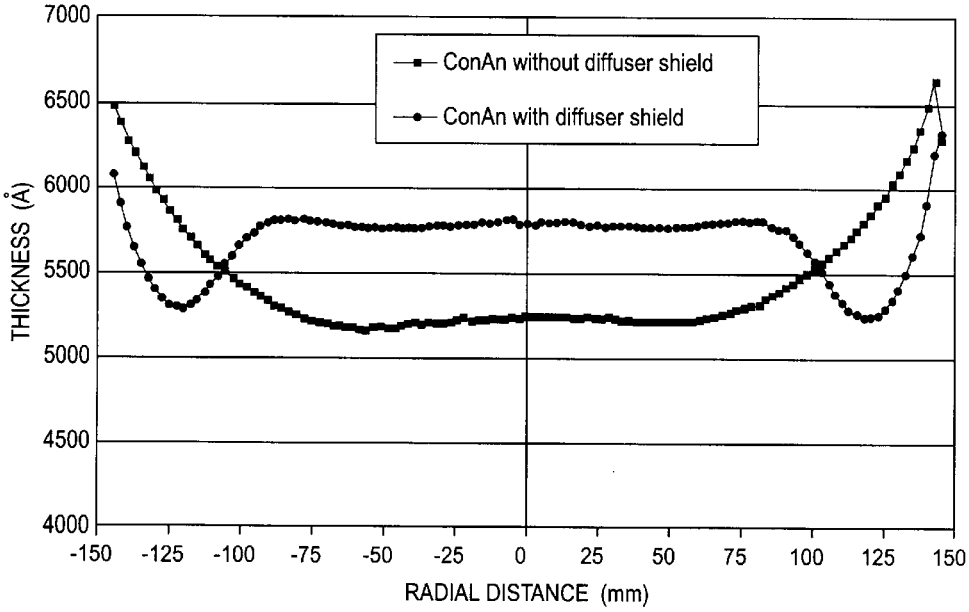
FIG. 5 includes a graph in which are plotted exemplary measurements of plating thickness resulting from use of concentric anodes with and without a diffuser shield.

In the graph of FIG. 5, plating thickness in units of Å is plotted as a function of a radial distance in mm from the center of a substrate wafer. The data were collected using a four-point resistance measurement probe performing a diameter scan. A simple ring-shaped diffuser shield having an 8-inch inner lip diameter was used during electroplating operations. The square-shaped data symbols represent measurements resulting from use of concentric anodes ("ConAn") without a diffuser shield. The circle-shaped data symbols represent measurements of ConAn with a ring-type diffuser shield. Without a diffuser shield, plating thickness was uniform out to about 90 mm radius, but the thickness was disproportionately high beyond 100 mm. With a diffuser shield, plating thickness was higher in the center zone and leveled out about 100 mm. The diffuser shield suppressed current beyond 100 mm, where a ConAn is not very effective. The diffuser shield tended to redirect current by forcing more current towards the center, and generally away from the very edge. But in doing so, it created a trough at about 125 mm (again, the "ringing effect"). A strong "terminal effect", that is, thick plating at the extreme edge of the wafer (135–150 mm radial distance), was apparent from both sets of measurements, but the edge thickness, the total thickness range, and the standard distribution of the thickness were substantially less for the wafer treated using the diffuser shield.

FIGS. 5 and 6 show alternative embodiments of diffuser shields in accordance with the invention. Diffuser shield 400 in FIG. 5 has an inner annular ("lip") diameter 402 of 9.5 inches, and an inner notch diameter at 404 of 11.5 inches. Diffuser shield 400, referred to as an alpha-style shield below, is characterized by approximately rectangular open areas, or notches, 410. Diffuser shield 400 comprises two annular rings, ring "A" and ring "B". Ring A has an annular lip 420 defining a circular open area 430 having lip diameter 402. Similarly, ring B has an annular lip 421 defining a circular open area 431 having lip diameter 402. Each ring also has open indents in its lip, each indent approximately two times the area of notches 410 depicted in FIG. 6. The indents in the lip of ring A define closed area tabs A, as indicated in FIG. 6. The indents in the lip of ring B define closed area tabs B, as indicated in FIG. 6. FIG. 6 indicates the radial arc length A' corresponding to each regularly-spaced indent of ring A, and an arc length B' corresponding to each regularly-spaced indent of ring B. As depicted in FIG. 6, tabs A of ring A overlap approximately one-half of the open area of indents of ring B. Similarly, tabs B of ring B overlap approximately one-half of the open area of indents of ring A. The two rings are aligned substantially about a central axis one on top of the other and are operably connected so that rotation of one or more rings increases or decreases the notched open space 410 of shield 400. For example, when ring B is rotated in either direction so that tabs B overlap tabs A, then the open area of notches 410 approximately doubles. Thus, rotation of one or more of rings A, B, typically on the order of several arc degrees, varies the closed and open areas of the shield, and thereby the degree of shielding of a wafer. Similar shields are constructed using two or more rings, in which dimensions and shapes are selected to optimize shielding properties. As depicted in FIG. 6, alpha shield 400 has a nominal "100 percent open" notched area 410. Rotation of the cooperating rings of shield 400 to double the open notched area results in a nominal "200 percent open" shield. Preferably, an actuator selectively rotates one or more rings during electroplating operations to vary dynamically the closed and open areas of the shield.

Figure 7:
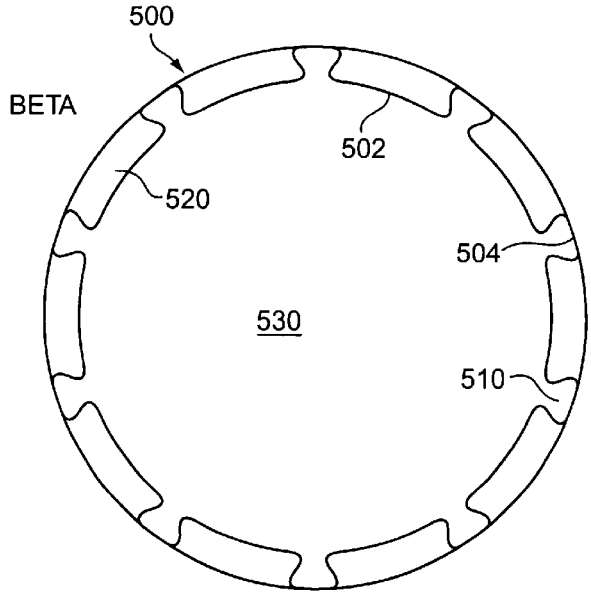
FIG. 7 depicts a beta-type diffuser shield in accordance with the invention having wedge-shaped notches.

FIG. 7 depicts another embodiment of a diffuser shield 500, referred to as a beta-style shield. Beta shield 500 has an inner annular lip diameter 502 of 9.5 inches and an outer notch diameter 504 of 11.5 inches. Lip 520 defines a circular open area 530 having diameter 502. Notched open areas 510 in annular lip 520 have a wedge shape, so that the amount of shielding at inner annular diameter 502 is greater than at radial locations between inner diameter 502 and outer diameter 504.

It should be noted that a wafer substrate is rotated during electroplating operations in accordance with the invention. Therefore, the shielding of a substrate surface by closed areas of lips 420, 520 is time averaged over a period of time related to the rotational speed of the substrate and the open notched areas 410, 510.

EXAMPLE 3

Figure 8:
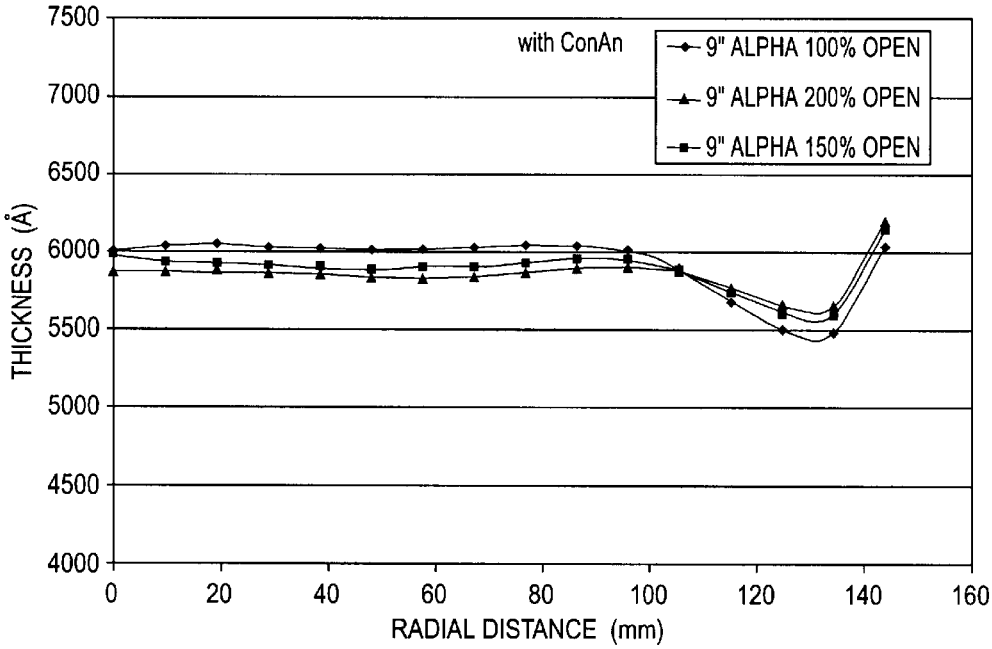
FIG. 8 contains a graph with data showing the effect of different open and closed areas of a diffuser shield in accordance with the invention on plating thickness profiles.

In the graph of FIG. 8, plating thickness in units of Å is plotted as a function of a radial distance in mm from the center of a substrate wafer. Plating was performed using inner and outer concentric anodes, as in Example 2. The electroplating apparatus included a "streamline"-type insert shield, as described below, having an 11-inch (279 mm) inside diameter. An alpha-type diffuser shield as depicted in FIG. 6, but having a nine-inch inner lip diameter, was used to influence current flux distribution. A fixed open area of the diffuser shield was used throughout the plating process of each wafer, and the wafers were all plated to an average thickness of 6000 Å. The diamond-shaped data symbols represent measurements resulting when the alpha-type shield had a nominal 100 percent opening, as explained with reference to FIG. 6 above. The square-shaped data symbols represent measurements resulting when the alpha-type diffuser shield had a nominal 150 percent opening. The triangle-shaped data symbols represent measurements when the alpha-type diffuser shield had a nominal 200 percent opening. Measurements show that increasing the amount of opening improved the radial current distribution in the range of about 100–135 mm, thereby decreasing the depth of a trough centered at 130 mm. The improvement in time-averaged shielding in the zones beyond 100 mm was achieved without adversely affecting the overall profile.

EXAMPLE 4

Figure 9:
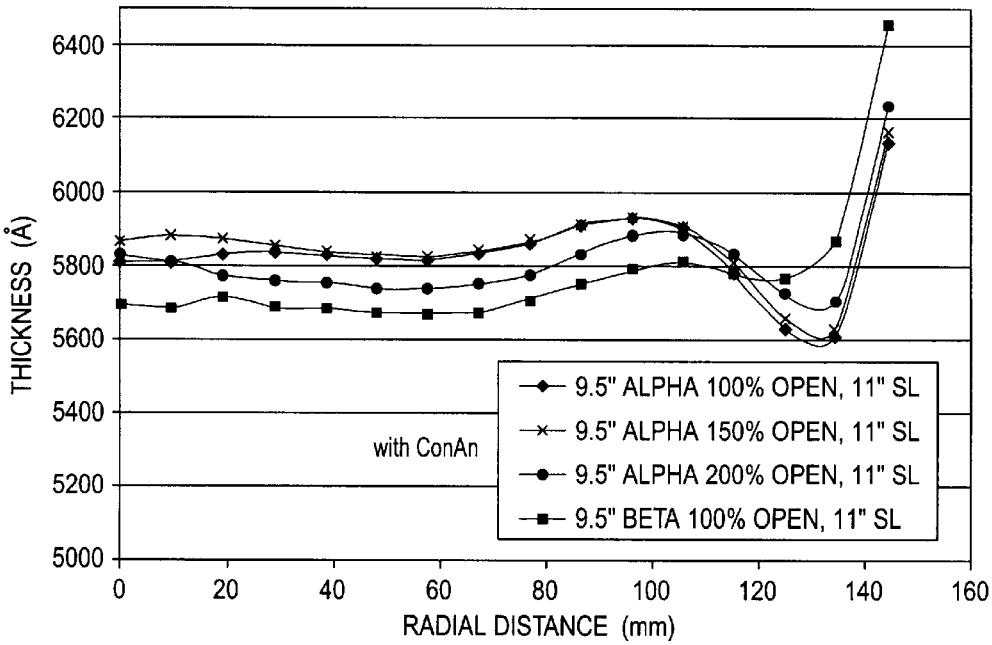
FIG. 9 contains a graph with exemplary data showing the effects of open surface area and insert shape in accordance with the invention on plating thickness profiles.

Diffuser-shield designs in accordance with the invention were studied. In the graph of FIG. 9, plating thickness in units of Å is plotted as a function of a radial distance in mm from the center of a substrate wafer. Plating was performed using concentric anodes, as in Example 2. The electroplating apparatus included a "streamline"-type insert shield, as described below, having an 11-inch (279 mm) inside diameter. Alpha-type diffuser shields having a 9.5-inch inner diameter and various degrees of opening, and a beta-type shield having a 9.5-inch inner lip diameter, as depicted in FIG. 7, were used to influence current flux distribution in a series of electroplating operations. Comparison of the data of FIG. 9 indicates that the overall shape of the radial thickness distribution improved through use of a beta-type shield. It is believed that the wedge-shaped notches of a beta-type shield redirected a sufficient amount of current from the 100–120 mm zone into the 120–145 mm zone to compensate substantially the characteristic trough associated with an inner concentric anode alone. Apparently, the current diffused outwards, while a sufficient amount of shielding was maintained in the range 100–135 mm. Thus, the beta-type diffuser shield resulted in a major improvement in global thickness uniformity, although the edge (>140 mm) of the plating layer was slightly thicker than with alpha-type shields.

EXAMPLE 5

Figure 10:
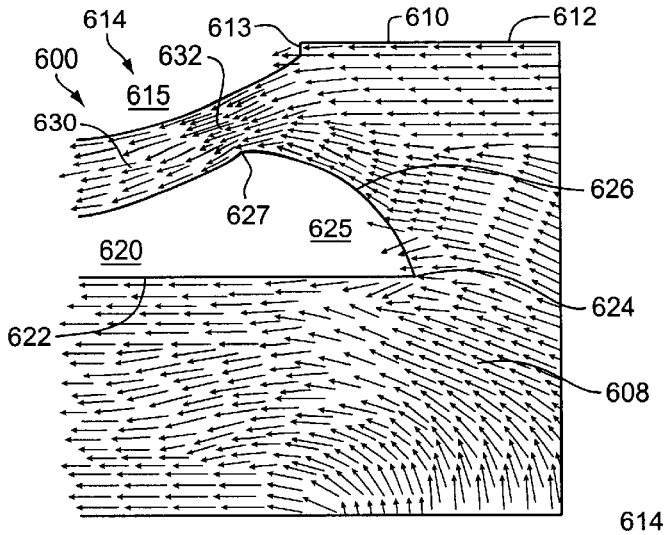
FIGS. 10–12 depicts in schematic form the results of calculations using mathematical models to simulate fluid flow patterns of plating fluid systems in accordance with the invention.
Figure 11:
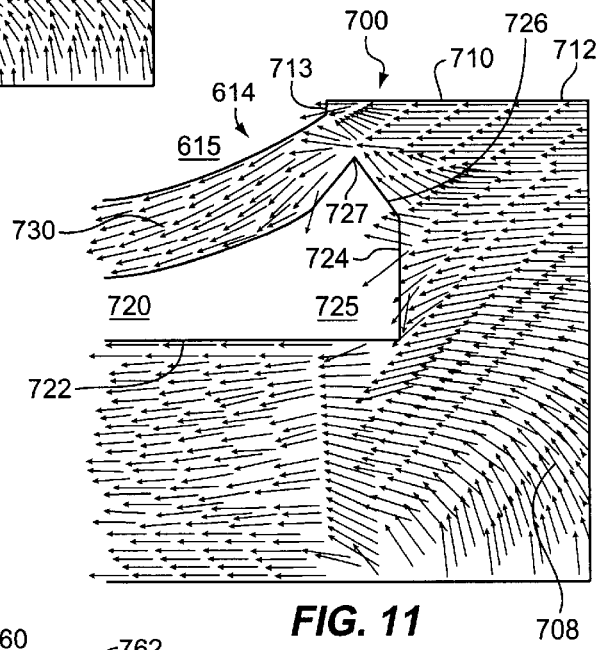
Figure 12:
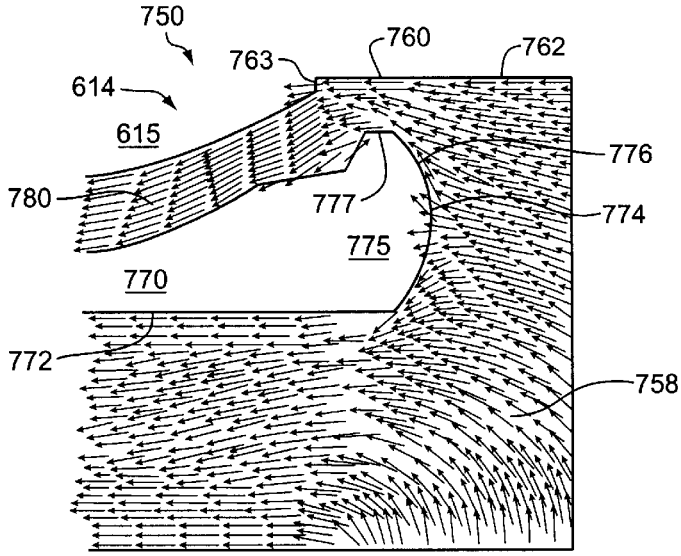

FIGS. 10–12 each depict a section of a mathematical model of an apparatus in accordance with the invention. The model simulated fluid flow patterns of plating fluid in an apparatus during electroplating operations. Physical dimensions and operating conditions of the model were similar to those used in Example 1. FIGS. 10–12 each depict simulated fluid flow of plating fluid near the edge zones of wafer substrates during electroplating. Calculations were performed using different shapes of insert shields in the mathematical model.

FIG. 10 depicts schematically a section 600 of a mathematical model of an apparatus in accordance with the invention. FIG. 10 shows arrows representing the direction and relative pressure of fluid flow of plating fluid in plating bath 608 near the edge zone 610 of a wafer substrate 612 mounted in clamshell-type substrate holder 614. Insert shield 620 is located in plating bath 608 proximate to cup 615 of substrate holder 614. In certain preferred embodiments in accordance with the invention, an insert shield 620 has a substantially flat bottom 622. In the embodiment depicted in FIG. 10, the innermost ridge 624 of insert shield 620 relative to the central axis of the apparatus is located at a radial distance of 5.5 inches from the central axis of wafer substrate 612. Thus, insert shield 620 has an inside diameter of 11.0 inches. Insert shield 620 has a rim portion 625 that comprises its inner radial region closest to the central axis of the apparatus. Rim portion 625 has an outer, contoured edge surface 626. Cup 615 and insert shield 620 define a flow gap 630 approximately 0.1 inch wide through which plating fluid flows substantially radially outwards past the edge zone 610 of wafer substrate 612 towards an outer, container wall, such as container wall 110 of FIG. 1. Preferably, an insert in accordance with the invention is designed for particular electroplating applications so that rotation of wafer holder 614 and wafer substrate 612 creates a pumping action drawing plating fluid in a substantially horizontal direction across the exposed plating surface of wafer 612. The general shape of rim portion 625 is referred to herein as the "streamline" shape.

FIG. 11 depicts a section 700 of a mathematical model of an apparatus in accordance with the invention. FIG. 11 shows arrows representing the direction of fluid flow of plating fluid in plating bath 708 near the edge zone 710 of a wafer substrate 712 mounted in substrate holder 614. Insert shield 720 is located in plating bath 708 proximate to cup 615 of substrate holder 614. Insert shield 720 has a substantially flat bottom 722. In the embodiment depicted in FIG. 11, the innermost ridge 724 of insert shield 720 relative to the center of the apparatus is located at a radial distance of 5.5 inches from the center of wafer substrate 712. Thus, insert shield 720 has an inside diameter of 11.0 inches. Insert shield 720 has a rim portion 725 that comprises its inner radial region closest to the center axis. Rim portion 725 has an outer, contoured edge 726. Cup 615 and insert shield 720 define a flow gap 730 approximately 0.1 inch wide through which plating fluid flows substantially radially outwards past the edge zone 710 of wafer substrate 712 towards an outer, container wall, such as container wall 110 of FIG. 1. The general shape of rim portion 725 is referred to herein as the "squared" shape.

FIG. 12 depicts a section 750 of a mathematical model of an apparatus in accordance with the invention. FIG. 12 shows arrows representing the direction of fluid flow of plating fluid in plating bath 758 near the edge zone 760 of a wafer substrate 762 mounted in substrate holder 614. Insert shield 770 is located in plating bath 758 proximate to cup 615 of substrate holder 614. Insert shield 770 has a substantially flat bottom 772. In the embodiment depicted in FIG. 12, the innermost ridge 774 of insert shield 770 relative to the center of the apparatus is located at a radial distance of 5.5 inches from the center of wafer substrate 762. Thus, insert shield 770 has an inside diameter of 11.0 inches. Insert shield 770 has a rim portion 775 that comprises its inner radial region closest to the center axis. Rim portion 775 has an outer, contoured edge 776. Cup 615 and insert shield 770 define a flow gap 780 approximately 0.1 inch wide through which plating fluid flows substantially radially outwards past the edge zone 760 of wafer substrate 762 towards an outer, container wall, such as container wall 110 of FIG. 1. The general shape of rim portion 775 is referred to herein as the "bullnose" shape.

Comparison of results of the model simulations of plating fluid flow depicted in FIGS. 10–12 indicate that the streamline-shaped insert shield of FIG. 10 provides relatively smooth fluid flow along the edge 610 of wafer substrate 612 and into flow gap 630 between the insert shield and the cup of a clamshell-type substrate holder. FIGS. 11–12 indicate that plating fluid flow is constricted in the plating bath between a wafer edge 710 and a squared -shaped insert shield 720, and between a wafer edge 760 and a bullnose-shaped insert shield 770. The resulting rapid constriction of flow generates turbulence and increases mass transfer at the plating surface. Under certain conditions, this is undesirable for achieving uniform thickness. It should be noted that the streamline arrows in FIG. 10 also indicate a constriction of flow as the cross-sectional area for flow decreases in a radial direction; nevertheless, the constriction occurs at a location 632 radially outwards of the seal/substrate interface of 613. In contrast, the flow constriction indicated by the streamline arrows in FIGS. 11–12 occurs at a location radially inwards of seal/substrate interfaces 713, 763. Related to the location of the apparent region of flow constriction in FIGS. 10–12, is the location of the apex 627, 727, 777 of rim portions 625, 725, 775, respectively. Apex 627 in FIG. 10 is located radially outwards of seal/substrate interface 613. In contrast, apex 727, 777 in FIGS. 11, 12, respectively, is located radially inwards of seal/substrate interface 713, 763, respectively.

A series of plating operations in accordance with the invention were conducted using different insert shields. An apparatus and electroplating operating conditions similar to those of Example 2 were used.

EXAMPLE 6

Figure 13:
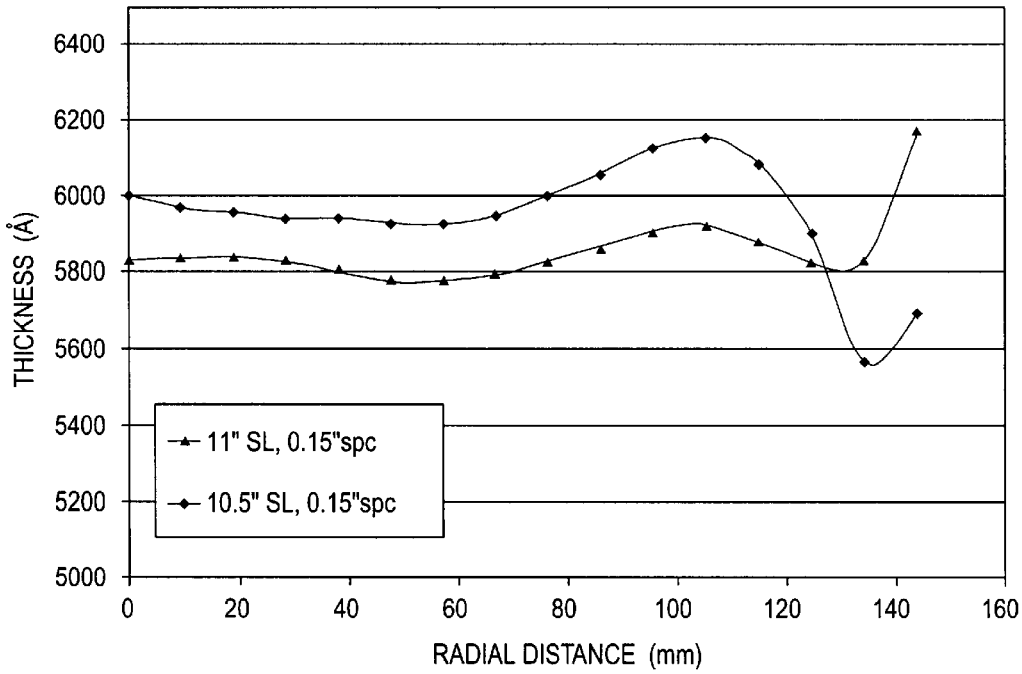
FIG. 13 contains a graph presenting exemplary data to compare the effect in accordance with the invention of insert-shield diameter on plating thickness.

The effect of the inside diameter of insert shields relative to wafer edge was studied. In the graph of FIG. 13, plating thickness in units of Å is plotted as a function of a radial distance in mm from the center of a substrate wafer. Plating was performed using concentric anodes, as in Example 2. The apparatus included a beta-type diffuser shield having an inner lip diameter of 9.5 inches.

A streamline-type insert shield having a 10.5-inch inside diameter was attached below the cup of a clamshell-type substrate holder, forming a flow gap having a width of 0.15 inches. The diamond-shaped data symbols in the graph of FIG. 13 represent measured plating thickness values associated with the 10.5-inch diameter. A similar streamline-type insert shield having a 11.0-inch inside diameter formed a flow gap having a width of 0.15 inches. Corresponding measurement values of plating thickness are represented by triangle-shaped data symbols in FIG. 13.

The measurements plotted in FIG. 13 indicate that the insert having 10.5-inch inside diameter resulted in overplating in the mid-zone around 100 mm, and in a large ringing effect, shown by the large trough at 120–140 mm in the curve of FIG. 13. Overshielding of the edge of the wafer by the smaller inside radius resulted in low plating thickness at the edge of the wafer (135–150 mm). The insert shield having a 11.0-inch inside diameter provided more uniform plating out to the edge zone, but showed a terminal effect at the edge (140–150 mm).

EXAMPLE 7

Figure 14:
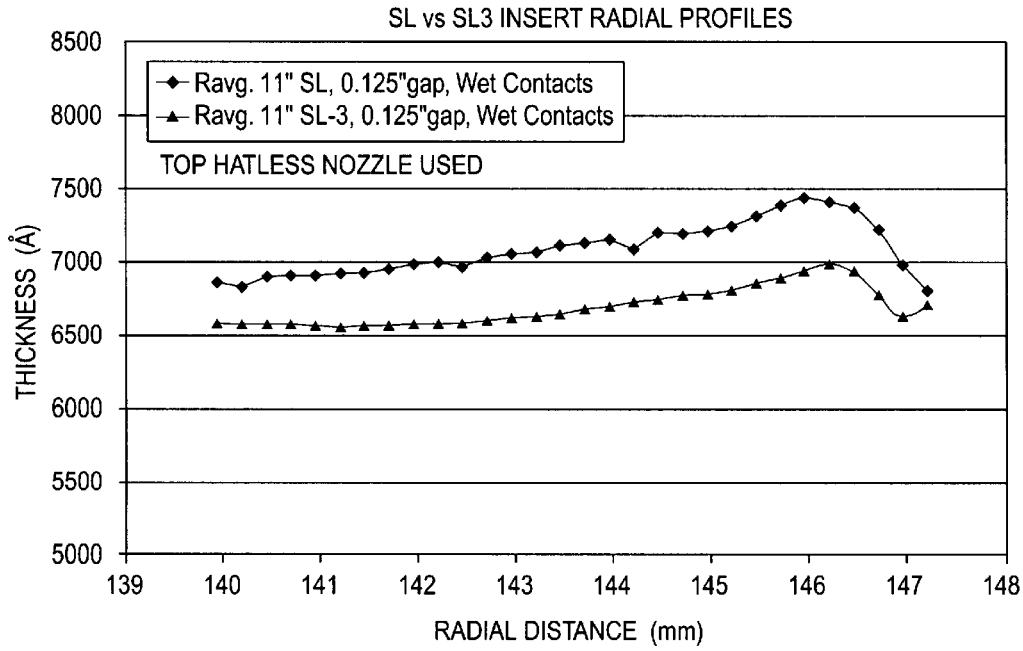
FIG. 14 contains a graph presenting exemplary data to compare the effect in accordance with the invention of insert-shield shape on plating thickness.

The effect of insert-shield shape was studied. In the graph of FIG. 14, plating thickness in units of Å is plotted as a function of a radial distance in mm from the center of a substrate wafer. Plating was performed using concentric anodes, as in Example 2. The apparatus included a beta-type diffuser shield having an inner lip diameter of 9.5 inches.

Figure 17:
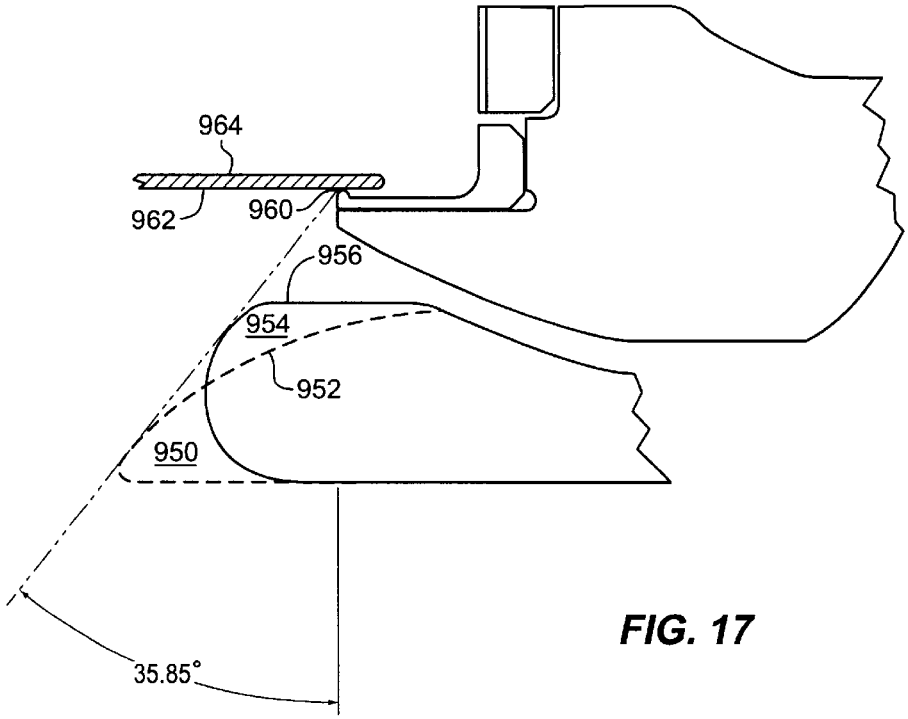
FIG. 17 depicts schematically two insert shields in accordance with the invention having different shapes but the same angle θ.

A streamline-type insert shield (shaped as in FIG. 10) having an 11.0-inch inside diameter was attached below the cup of a clamshell-type substrate holder, forming a flow gap having a width of 0.125 inches. The diamond-shaped data symbols in the graph of FIG. 14 represent measured plating thickness values associated with the streamline insert shield. A modified streamline-shaped insert shield (as depicted in FIGS. 16–17 below) having a 11.0-inch inside diameter formed a flow gap having a width of 0.125 inches. Corresponding values of plating thickness are represented by triangle-shaped data symbols in FIG. 14.

Comparison of the curve as in FIG. 14 indicates that the modified streamline-shaped insert shield flattened the thickness profile (improved thickness uniformity), particularly near the edge. It is believed that the more rounded rim portion of the modified streamline-type insert shield compared to the more fluted or horn-shaped cross-section of a streamline-type insert blocks current paths that would otherwise travel first towards the wafer and then back toward the wafer edge into the flow gap. This blocking increases the resistance for current flow (through the electrolyte) to the very edge of the wafer, and thereby increases the amount of shielding near the extreme edge (143–146 mm).

EXAMPLE 8

The effect of the width of the flow gap was studied. In the graph of FIG. 15, plating thickness in Å-units is plotted as a function of a radial distance in mm from the center of a substrate wafer. Plating was performed using concentric anodes, as in Example 2. The apparatus included a beta-type diffuser shield having an inner lip diameter of 9.5 inches.

A modified streamline-type insert shield having an 11.0-inch inside diameter was attached below the cup of a clamshell-type substrate holder holding a substrate wafer having a seed layer thickness of 400 Å. The square-shaped data symbols in the graph of FIG. 15 represent measured plating thickness values associated with the gap width of 0.125 inches. A similar modified streamline-type insert shield having a 11.0-inch inside diameter formed of flow gap having a width of 0.2 inches with a substrate holder holding a substrate wafer. Corresponding values of plating thickness are represented by circle-shaped data symbols in FIG. 15. The range of thickness, 845.4 Å, of the wafer treated using the larger gap was more than twice that with the smaller gap, 415.7 Å.

The data indicate that using a smaller flow gap width, and thereby a smaller gap size, substantially decreased the edge current and edge plating thickness. It is believed that this occurred because the current path around the back of the insert shield through the flow gap was restricted by narrowing the flow gap width and changing the insert-shield tangent angle, θ, as discussed below.

In designing the shape, size, and position of an insert shield in accordance with the invention, it has been determined that the angle, θ, between a line drawn vertically from the seal/substrate interface point and a line drawn from the seal/substrate interface point tangent to the rim portion of an insert shield is a primary parameter shaping the electrical shielding provided by the insert shield at the wafer edge, and hence the wafer-edge plating profile. FIG. 16 shows wafer substrate 810 having a plating surface 812. Wafer substrate 810 is supported at seal/substrate interface 816 by compliant seal 820 in cup 822 of clamshell-type substrate holder 824. Three exemplary insert shields are depicted schematically in FIG. 16. Insert shield 830 has a rim portion 832 with a streamline shape. Tangent line 834 makes an angle, θ, of 26.31° with respect to vertical at seal/substrate interface 816. Insert shield 840 has a rim portion 842 with a squared shape. Tangent line 844 makes an angle, θ, of 31.61° to vertical at seal/substrate interface 816. Insert shield 850 has a rim portion 852 with a bullnose shape. Tangent line 854 makes an angle, θ, of 54.48° to vertical at seal/substrate interface 816. It has been determined that when θ has a value in a range of about from 20° to 45°, an insert shield provides good electrical shielding at wafer edge 818. Generally, the larger the value of θ, the higher is the amount of wafer-edge electrical shielding. For the same or similar values of θ, the amount of wafer-edge electrical shielding a similar. It is understood, however, that other factors also influence the amount of electrical shielding, such as discussed with reference to FIG. 14.

After selection of an approximately optimal angle θ for electrical shielding, the shape, size and location of the insert shield is adjusted to obtain a desired fluid and current flow profile. A desired flow profile is typically one with a flow streamline substantially parallel to the plating surface out to its very edge, allowing substantially uniform mass transfer at the entire plating surface. The direction and the amount of flow through the flow gap between an insert shield and a substrate holder is influenced by several variables; for example, the shape of the rim portion of the insert shield and the size of the flow gap. As discussed with reference to FIGS. 10–12 above, a desired flow profile avoids constriction of fluid flow and resulting flow turbulence near the plating surface of a substrate. In FIGS. 11–12, unfavorable fluid flow patterns showed flow constriction near the edge zones of wafers 710, 762, respectively. In contrast, a desirable flow pattern in FIG. 10 indicated essentially undisturbed parallel streamlines radially outwards along the plating surface of wafer substrate 610 beyond seal/substrate interface 613. Preferably, constriction of fluid flow occurs, if at all, at a location radially outwards from the edge of the wafer.

FIG. 17 depicts the profiles of rim portion 950 of streamline-type insert shield 952, and of rim portion 954 of modified streamline-type insert shield 956. The line tangent to the rim portion of both insert shields makes an angle θ of 35.85° with the vertical at seal/substrate interface 960. Thus, both insert shields provide similar electric shielding of edge zone 962 of wafer substrate 964. It is known that both insert shield 952 and insert shield 956 provide good flow patterns of plating fluid in a radially outwards direction along the plating surface of wafer substrate 964, including past edge zone 962. On the other hand, some insert shields having rim portions with other, different profiles with the same angle θ provide less favorable fluid flow patterns, even though they provide similar electric shielding. For example, it is believed that a blunt, squared profile, as depicted in FIG. 11, produces relatively turbulent flow with non-parallel streamlines to the wafer at its sharp extreme edge, causing a flow stagnation region. It is further believed that an insert shield that provides a constriction of fluid flow located radially inward from seal/substrate interface 960 causes less favorable flow than insert shields 952, 956.

The selection and optimization of insert shield variables depend on numerous parameters, such as, seed layer thickness, pattern density, desired plating thickness profile, wafer size, electrolytic plating fluid properties, wafer rotation speed, plating voltage, and on the particular characteristics of an electroplating apparatus. Nevertheless, for the particular electroplating operations described herein, good plating uniformity control is obtained with an insert-shield located to have an inside diameter of about 10.5 to 12 inches relative to the center of 300-mm wafer and having a smoothly contoured rim portion with an angle θ in a range of 20–40°. A flow gap width generally is in a range of about 0.075 to 0.3 inches, preferably 0.125 to 0.2 inches. Rim portion of insert shield 956 depicted in FIG. 17 typically has a radius of curvature in a range of about 1/16 to one-half inch, preferably about 1/8 inch. As the radius of curvature of the rim portion of an insert increases, the rim portion becomes more blunt, increasing turbulence in the plating fluid flowing in a radially outwards direction along the edge zone of a wafer. As described herein, there really is no lower limit of the radius of curvature of an insert shield in accordance with the invention. The insert may be extremely thin, and its rim may have a very small radius of curvature. Nevertheless, in practice, mechanical limitations restrict use of such extreme designs. The insert shield preferably is substantial enough to generate pumping action of plating fluid in a radially outwards direction through the flow gap as the wafer substrate rotates, thereby providing sufficient fluid flow for the plating operations.

EXAMPLE 9

Figure 18:
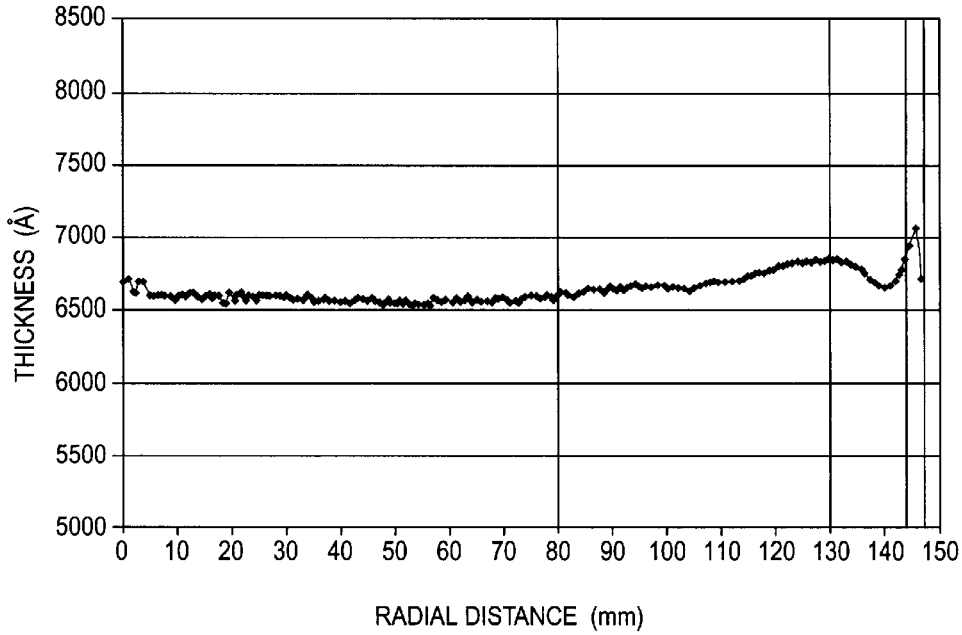
FIG. 18 shows a graph in which plating thickness is plotted as a function of radial distance on an exemplary wafer treated in accordance with the invention.
Figure 19:
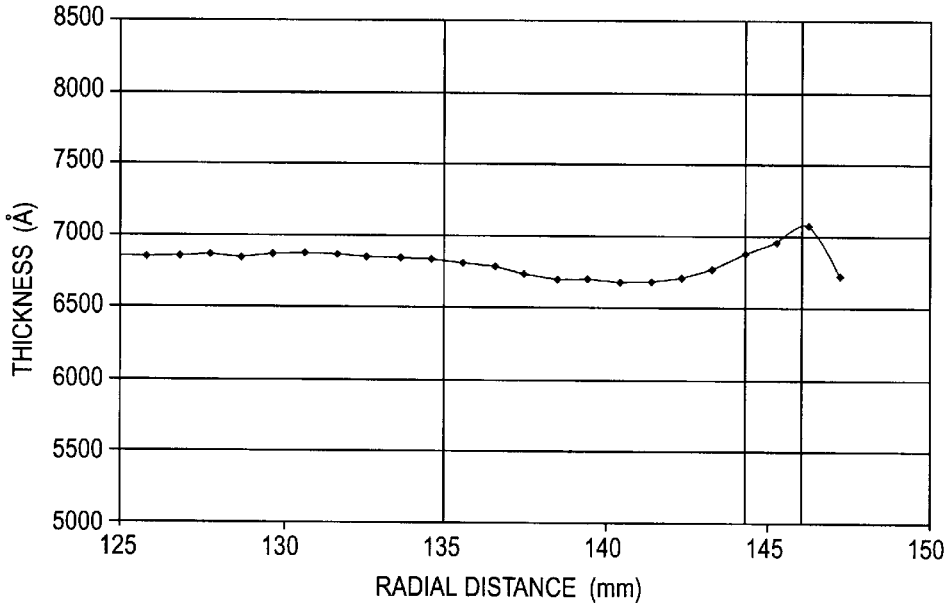
FIG. 19 shows a graph in which the data of FIG. 18 in the middle and edge zones of the wafer were plotted with an expanded abscissa.

Table 2, together with FIGS. 18–19, outlines some of the principal factors and elements that are selected and preferably dynamically varied in accordance with the invention to influence plating thickness. An exemplary apparatus and a method in accordance with the invention were configured for electroplating of a copper layer of 0.6 μm (6000 Å) thickness having a thickness uniformity in the range of 240 Å, as indicated in Table 2. It is understood, however, that embodiments in accordance with the invention are useful for a wide range of desired plating thicknesses. In accordance with the invention, selective use of inner and outer concentric anodes, instead of a single conventional anode, influences current density and plating rate in the center zone of the wafer substrate, out to a radial distance of about 80 mm on a 300 mm wafer. A diffuser shield in accordance with the invention influences the current density and plating rate in the middle zone, from approximately 80 to 135 mm. An insert shield in accordance with the invention provides good control in the edge zone, approximately from 135 to 146 mm. As discussed above, final adjustments to the shape and size of the insert shield, and to its location relative to the wafer substrate and the substrate holder influence current density, fluid flow and thereby plating thickness in the edge zone of a wafer substrate. At the extreme edge of the wafer, proximate to the seal/wafer interface, numerous factors are selected and varied in accordance with the invention to minimize plating thickness distribution and to optimize plating quality; for example, insert shield variables, quality of electrical contacts at the dry edge of the wafer, seal design and quality, substrate holder (cup) design, the amount of current flowing inward in the opposite direction of the fluid flow, and wafer pre-wetting and handling prior to electroplating.

TABLE 2

| Zones, by radius (mm) | Uniformity Goal (0.6 μm layer) | Field-Shaping Elements |
|---|---|---|
| 0–80 mm | 240 Å | ConAn process |
| 80–135 mm | 240 Å | Diffuser shield |
| 135–146 mm | 240 Å | Insert shape and size; gap width |
| 146–147.2 mm | 240 Å | Insert gap width, contact quality, seal design, cup design, flow gap current, edge bubbles/defects |

FIG. 18 shows a graph in which plating thickness is plotted as a function of radial distance on an exemplary wafer treated in accordance with the invention. FIG. 19 shows a graph in which the data of FIG. 18 in the middle and edge zones of the wafer were plotted on an expanded abscissa. These measurements were performed using a RML laser-Doppler thickness measuring device commercially available from Rudolph Corporation, Flanders, N.J. The measurement technique uses a very small measurement spot size (10 μm) and, therefore, was able to measure the outermost extremities of the plated surface. The results in FIG. 19 showed that embodiments in accordance with the invention achieved good thickness uniformity of the plated film within a range of about 400 Å from the wafer center out to 147.3 mm (seal/wafer interface located at 148 mm).

EXAMPLE 10

Figure 20:
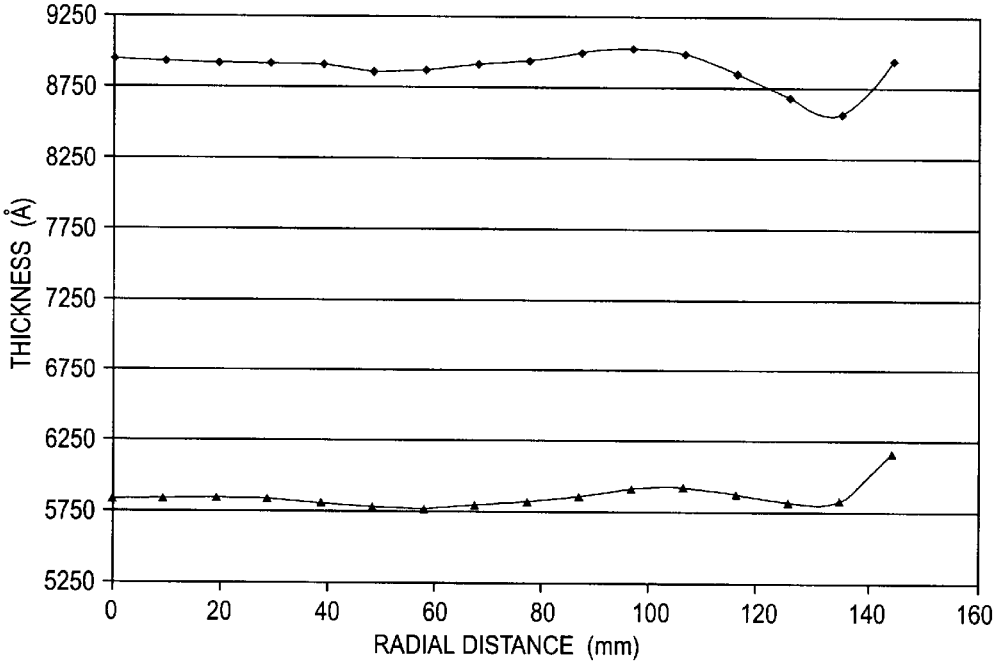
FIG. 20 contains a graph of exemplary data showing the effect of final plating thickness on plating thickness uniformity.

The effect of plating thickness on thickness uniformity using a fixed diffuser and insert shielding configuration was studied. In the graph of FIG. 20, plating thickness in units of Å is plotted as a function of a radial distance in mm from the center of a substrate wafer (4 point probe resistance measurements). Plating was performed using concentric anodes, as in Example 2. The apparatus included a beta-type diffuser shield as shown in FIG. 7 having an inner lip diameter of 9.5 inches, and a modified streamline-type insert shield having a fixed flow gap width of 0.125 inches and an inner diameter of 11.0 inches. After the wafer thickness reached 3000 Å, the anode current density at both concentric anodes was the same. The process was optimized to achieve as uniform of a deposit as possible having a plating thickness of 6000 Å.

Using the same apparatus and similar electroplating operations, a copper layer of approximately 6000 Å was plated on one wafer, and a layer of approximately 9000 Å was plated on a similar wafer, both initially having a 400 Å copper seed layer. Increasing the plated thickness resulted in increased thickness nonuniformity. More specifically, the thicker (9000 Å) film generally had a thinner edge (region beyond 100 mm) than the rest of the wafer. It is believed this was due to the fact that the diffuser and the insert shield, optimize to produce a thinner (6000 Å) film, over-shielded the edge-plating late in the process. In general, as a film thickens, the terminal effect diminishes, removing the need to compensate for it. The results plotted on both thickness curves of FIG. 20 represent time integrals of the current density as a function of radial position. The increased nonuniformity of the 9000 Å curve in the middle, diffuser-shielding (100–135 mm) and edge, insert-shielding (>135 mm) zones indicates the utility of dynamic variation of shielding to accommodate changes in physical conditions as plating thickness increases.

During plating of the 6000 Å film, initially the current density at the wafer edge was higher than the time-averaged current density. Later, the plating rate was such that the integrals over time of the current densities at all radial positions were substantially similar. But, when electroplating was continued to make a still thicker film, the edge-current integral became progressively less than the average. Dynamic shielding, especially combined with Conan, has the advantage, compared with fixed shielding, that the current distribution can be developed in a manner such that the current density on a wafer is substantially more uniform throughout the plating process. As feature sizes continue to become more restrictive, the local feature-filling current-density operating "window" (i.e., range of current densities over which filling occurs without voids) decreases. This increases the importance of controlling current density on a wafer.

EXAMPLE 11

A series of of integrated circuit wafer substrates were treated using different combinations of elements in accordance with the invention to study their effect on plating thickness and uniformity. The target thickness of the plated copper layer for all of the treated wafers was 6000 Å (0.6 μm). Measurements were made with a 4-point resistive probe instrument out to 144 mm radius; 481 points were collected in the scans and were azimuthally averaged to obtain data points plotted in FIG. 21.

An electroplating apparatus including a conventional anode and a squared-type insert having an inside diameter of 11.25 inches and making a flow gap width of 0.15 inches, as depicted in FIG. 11, but not including a diffuser shield, was used to electroplate Wafer 1 having a seed layer 400 Å thick. Measured data represented by triangle-shaped symbols were plotted in the graph of FIG. 21, in which plating thickness in units of Å is plotted as a function of a radial distance in mm from the center of a substrate wafer. The measured thickness range of this wafer was 2786 Å.

The same electroplating cell and process conditions were used to plate copper on Wafer 2 having a seed layer 1500 Å thick. Measured data are represented by circle-shaped symbols in FIG. 21. The measured thickness range of this wafer was 1834 Å.

An apparatus having having no diffuser shield, but having inner and outer concentric anodes and a squared-type insert shield with 11.25-inch inside diameter and a gap width of 0.15 inches in accordance with the invention was used to electroplate Wafer 3 having a seed layer 400 Å thick. Measured data are represented by diamond-shaped symbols in FIG. 21. The measured thickness range of this wafer was 1556 Å.

Finally, an apparatus having a beta-type diffuser shield (with 9.5-inch lip radius, as in FIG. 7), inner and outer concentric anodes, and a streamline-type insert shield with 11.0-inch inside diameter and a gap width of 0.15 inches was used to electroplate Wafer 4 having a seed layer 400 Å thick. Measured data are represented by square-shaped symbols in FIG. 21. The measured thickness range of this wafer was 394 Å.

Figure 21:
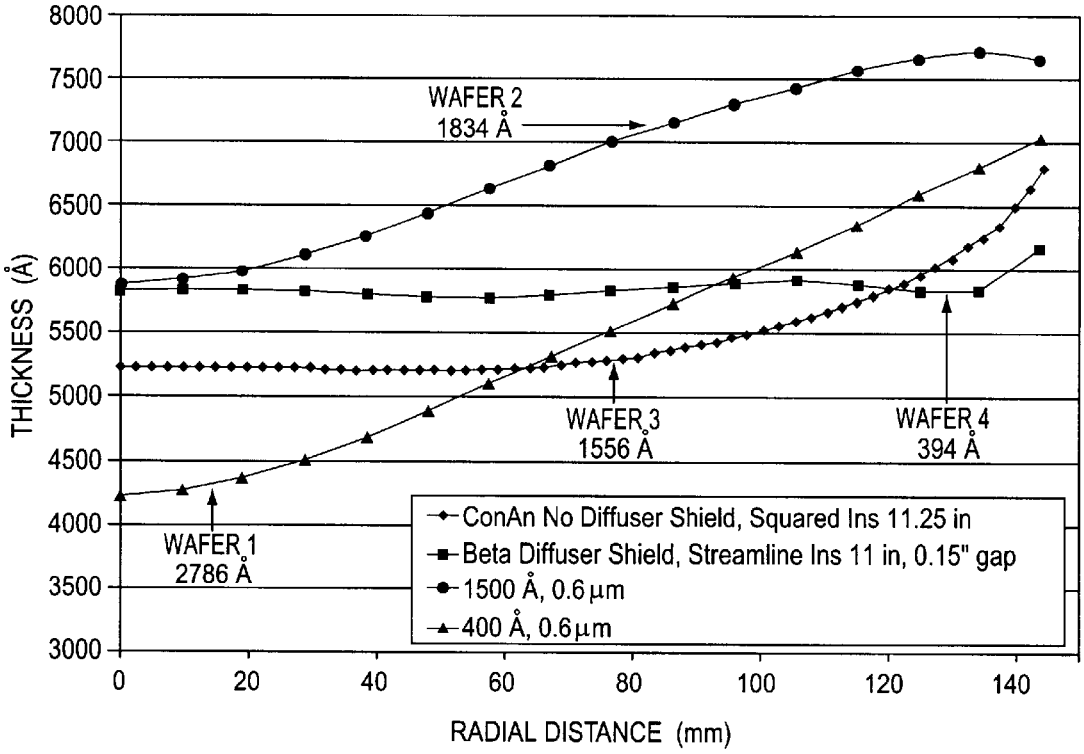
FIG. 21 contains a graph of exemplary data measured using various embodiments of elements and combinations in accordance with the invention.

The difference in Å units between the thickness and thinnest averaged measured thickness at each radial location on Wafers 1–4 are indicated in FIG. 21. Large thickness nonuniformity was measured in the respective layers of Wafers 1 and 2, which were plated using a nonpreferred insert shield, and without using concentric anodes or a diffuser shield. The design used for Wafers 1 and 2 yielded a 1–3% thickness non-uniformity (3 sigma) for 1500 Å seed layers plated to greater than 0.9 μm. Wafer 2 had a thin seed layer, 400 Å thick. The initial large non-uniformities in current density associated with thin seed layers caused the larger non-uniformities (initially more current at the edge) in the final plated layer of Wafer 2. The layer of Wafer 3, plated using concentric anodes in accordance with the invention, showed good thickness uniformity in the center zone, out to about 80 mm. Nevertheless, the thickness in the center zone was significantly less than the target thickness of 6000 Å. Furthermore, thickness increased significantly in the middle and end zones. In contrast, the difference between thickest and thinnest points measured on Wafer 4 was only about 400 Å. Plating thickness close to the target thickness of 6000 Å was uniform in the center and middle zones out to about 135 mm, with a moderate increase in thickness at the edge of the wafer. The measurements of Wafers 3 and 4 show the efficacy of concentric anodes, diffuser shields and insert shields, especially when used in combination in accordance with the invention.

Figure 22:
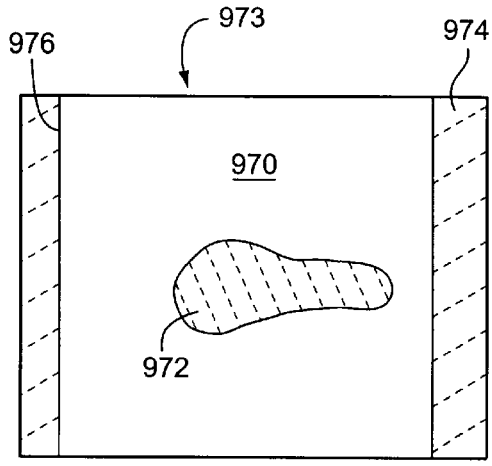
FIG. 22 depicts schematically corrosive damage of the seed layer in a wafer's dry edge region between the seal/substrate interface and the edge of the wafer as a result of contaminated electrical contacts.

A typical electroplating apparatus includes numerous, usually several hundred, electrical contacts for connecting a power supply to the cathodic seed layer of an integrated circuit wafer substrate, such as contact 160 contacting seed layer 162 near its edge 147, as depicted in FIG. 2. Wafer handling operations before and after actual electroplating operations inevitably result in slight contamination of electrical contacts 160 with corrosive, electroplating fluid. During the opening and closing of a substrate holder seal, dilute rinsate typically migrates into the contact region. As depicted in FIG. 22, direct exposure of a seed layer 970 to a power supply contact and plating fluid results in corrosive damage 972 of the seed layer at the contact point in the wafer's extreme edge region 973 between the seal/substrate interface 974 and the edge of the wafer 976. The relative amount of the damage is much greater in wafers having thin seed layers.

EXAMPLE 12

Azimuthal variations in plating thickness were measured on a series of integrated circuit wafer substrates to study the effect of pre-washing electrical contacts of the substrate holder in an apparatus. Identical electroplating conditions were used with each wafer, but pre-plating washing steps were varied. An electroplating cell in accordance with the invention was cycled to plate approximately 170 wafers during a period of about seven hours. A wafer having a seed layer 1500 Å thick was plated, with no pre-washing of electrical contacts of the substrate holder. A wafer having a seed layer 400 Å thick was electroplated with no pre-washing. A third wafer, with a 400 Å seed layer, was similarly electroplated, but after flooding the electrical contacts with deionized water. Finally, a fourth wafer, with a 400 Å seed layer, was electroplated after rinsing the electrical contacts with deionized water and drying them.

Figure 23:
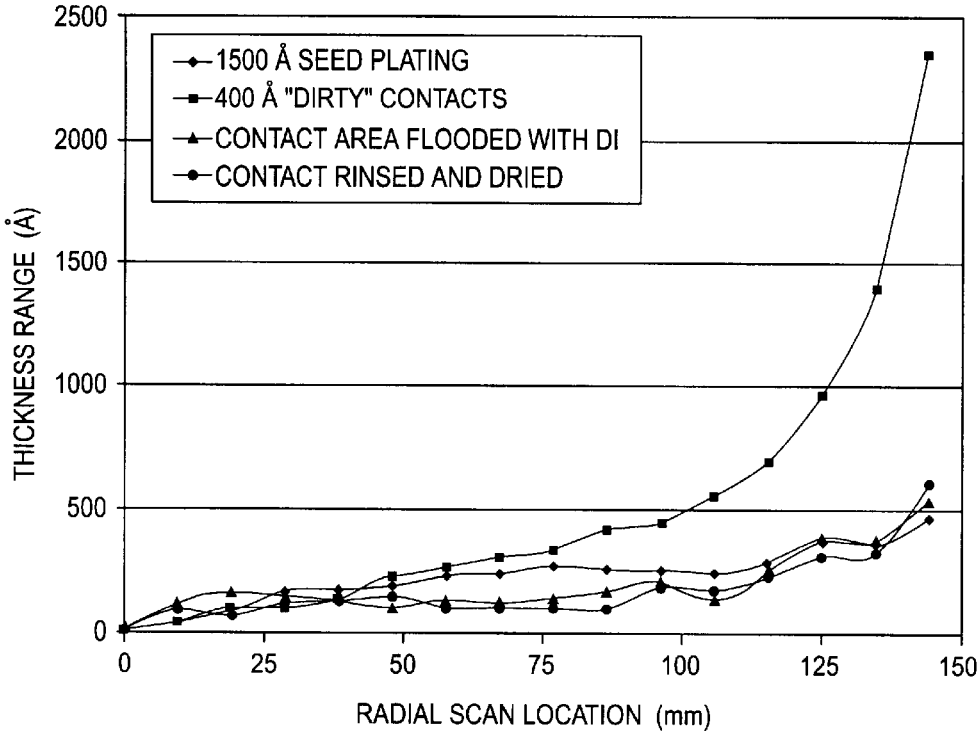
FIG. 23 contains a graph of data showing the effect of pre-washing electrical contacts in a substrate holder in accordance with the invention on plating thickness azimuthal uniformity.

FIG. 23 contains a graph in which thickness range in units of Å is plotted as a function of radial scan location in mm. The data plotted (square-shaped symbols) in the graph of FIG. 23 show that cycling and the absence of pre-washing before treating a very thin seed layer of 400 Å has very undesirable consequences, significantly increasing azimuthal plating nonuniformity (nonuniformity of thickness at a particular radius) in the edge zone of the wafer, compared to the wafer having a seed layer of 1500 Å (diamond-shaped symbols). On the other hand, rinsing the electrical contacts with deionized water in accordance with the invention before electroplating significantly improved plating uniformity on wafers having thin 400 Å seed layers.

Figure 24:
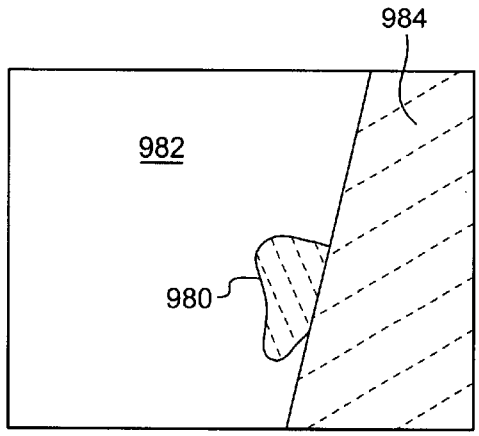
FIG. 24 depicts schematically a defect in the electroplated layer of a wafer substrate caused by the presence of an air bubble near the location of the seal/substrate interface during electroplating.

Many electroplating devices and methods include hardware and processing steps for immersing a substrate wafer facedown in the plating bath. During the immersion steps, air bubbles and, to a smaller extent, particulates become trapped on the plating surface of the wafer, particularly in the edge zone proximate to the seal/substrate interface. Air bubbles and particulates on the plating surface prevent contact of the electrolytic plating fluid with the plating surface, thereby preventing plating under the bubble area, either by shielding or not allowing the area to wet. This interference with electroplating causes plating thickness nonuniformities and serious defects in electroplated layer. FIG. 24 depicts schematically a defect 980 in the electroplated layer 982 of a wafer substrate caused by the presence of an air bubble near the location of the seal/substrate interface 984 during electroplating.

EXAMPLE 13

The number and size of air bubbles near the seal/substrate interface on the plating surfaces of a series of wafer substrates were measured to study the effect of pre-wetting treatments in accordance with the invention.

Table 3 contains data measured after various pre-wetting procedures.

TABLE 3

| Condition | # of bubbles | Size (mm) |
|---|---|---|
| Dry contacts | >500 | 0.1–0.5 |
| Wet contacts | <30 | 0.1–0.5 |
| Pre-rinse 10 sec | 20 | 0.05–0.1 |
| Pre-rinse 30 sec | 0 | |
| Prewet with DI on SRD | 22 | 0.1 |
| Prewet with surfactant on SRD | 4 | 0.05 |

When no pre-rinsing steps were conducted, the number of bubbles counted on the wafer surface exceeded 500. Such large defect counts create both a widely varying azimuthal edge-thickness distribution and poor edge die yield. When electrical contacts were pre-rinsed with deionized water, as described in Example 12, less than thirty bubbles were counted. It is believed that pre-wetting the electrical contacts indirectly results in wetting the seal/substrate interface and the plating surface of the substrate proximate to the interface. Pre-rinsing a wafer for ten seconds in deionized water (wafer face-up, with spray directed at wafer-seal interface) resulted in about twenty air bubbles, having a relatively small size. Pre-rinsing a wafer for 30 seconds resulted in no bubbles being observed. Pre-wetting a wafer with deionized water on a spin rinse dryer ("SRD"), thereby creating a thin film of deionized water on the wafer prior to insertion of the wafer into the clamshell substrate holder resulted in twenty-two bubbles measured. Finally, pre-wetting a wafer with a surfactant (10 g/liter water of polyethylene glycol polymer having a molecular weight of 1000 g/mole) on a spin rinse dryer resulted in only four bubbles with small diameter. The terms "pre-wetting", "pre-rinsing", "pre-washing" and similar terms are used synonymously herein.

Figure 25:
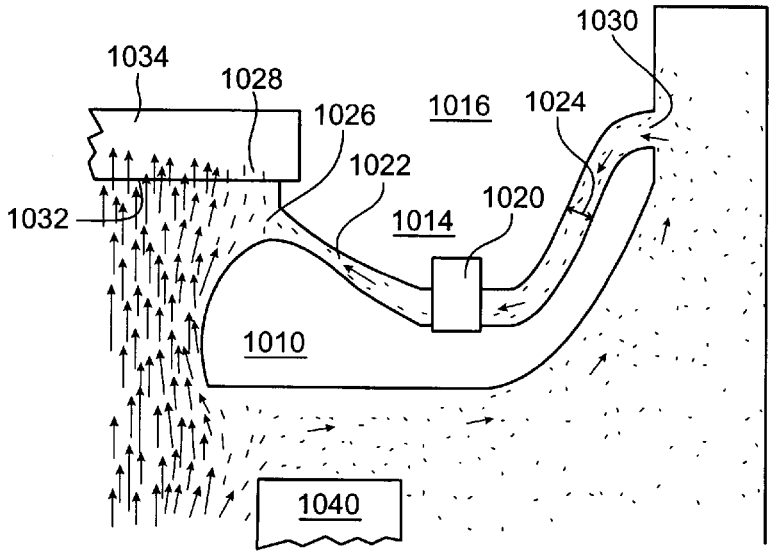
FIG. 25 depicts schematically an insert shield mounted rigidly to a cup of substrate holder by means of variable mounting spacers in accordance with the invention.
Figure 26:
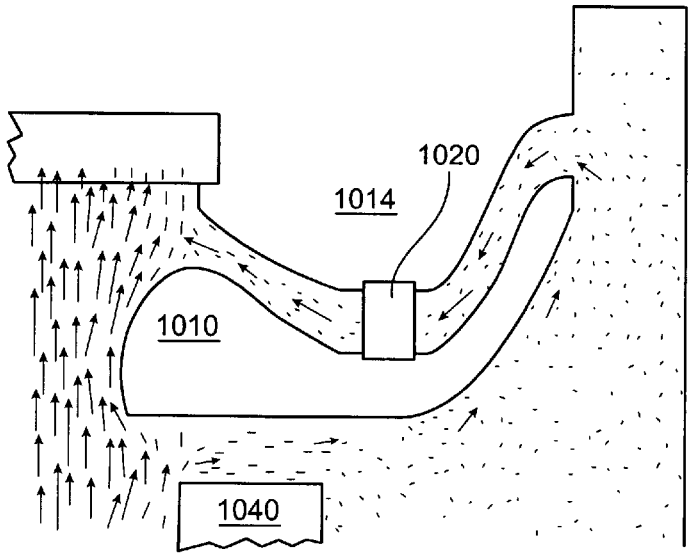
FIG. 26 depicts schematically a flow gap between the insert shield and the cup having a different size than in FIG. 25 as a result of dynamically changing the width of the flow gap in accordance with the invention.

In preferred embodiments in accordance with the invention, the size of the flow gap between an insert shield and the substrate holder is dynamically variable during electroplating operations. FIG. 25 depicts an insert shield 1010 mounted rigidly to a cup 1014 of substrate holder 1016 by means of variable mounting spacers 1020. Insert shield 1010 and cup 1014 define a flow gap 1022 through which plating fluid flows. The size 1024 of flow gap 1022 is typically designed to be substantially uniform from radially inward region 1026 of the gap near wafer edge 1028 to the radially outwards region 1030. The size of the flow gap influences the flowrate of plating fluid through the flow gap and also influences fluid flow patterns at the plating surface 1032 of substrate wafer 1034. In electroplating methods in accordance with the invention, it is typically desirable to have a smaller gap size initially (when the film is thin), thereby more strongly shielding the edge and reducing the terminal effect. Then, later in the process (as film resistance decreases), gap size is increased, as indicated by comparison of FIGS. 25 and 26, thereby reducing shielding of the wafer edge. To achieve this capability, a preferred apparatus in accordance with the invention includes a plurality of variable mounting spacers 1020, which spacers are actuated during a method in accordance with the invention to vary dynamically gap size 1024. The gap size is either infinitely adjustable or incrementally adjustable to a particular gap-size setting or settings, depending on the design of the control apparatus. In one embodiment, each of mounting spacers 1020 comprise a combination pneumatic cylinder and spring mechanism. When the cylinder is activated, the insert shield is positioned at an extreme (larger gap) position. When it is retracted, a spring maintains the insert shield in the closed (small gap) position. In another preferred embodiment, mounting spacers 1020 comprise a rotatable screw and nut-like configuration. This has the advantage of being continuously adjustable during electrochemical treatment operations, but the disadvantage of being more complex and expensive to build and control. Depending on the precise requirements of final layer quality and uniformity, feature size and filling requirements, the appropriate device and control system are selected.

Varying the interelectrode (wafer to anode) spacing during electrochemical treatment operations is a useful technique for varying the current distribution in the electrochemical bath during the process. Among other useful results, this allows dynamically varying the compensation for terminal resistance effects, which change during electroplating operations. Changing the wafer height, however, presents the practical difficulty of moving the substrate holder up or down, while maintaining the degree of immersion of the substrate holder in the liquid bath within a narrow range. In preferred embodiments, in which a wafer substrate is held in a clamshell-type substrate holder that protects the backside and edge of the wafer from contacts with corrosive electrolytic plating fluid, immersion of the substrate holder too deeply causes leaking and contamination of the apparatus with caustic chemicals. This causes undesirable plating of metal onto electrical contacts, corrosion of the wafer substrate in the edge zone, contamination of the backside of the wafer with copper, and general mechanical failure associated with accumulation of chemical crystals in the sealing region, among other problems.

Figure 27:
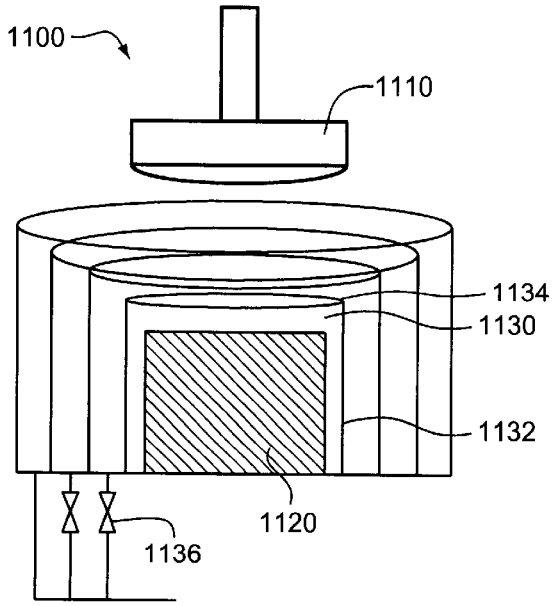
FIGS. 27–29 depict schematically an apparatus in accordance with the invention in which plating bath height is varied dynamically by selectively controlling the outlet flowrate of plating fluid from concentric containers with container walls having different overflow heights.
Figure 28:
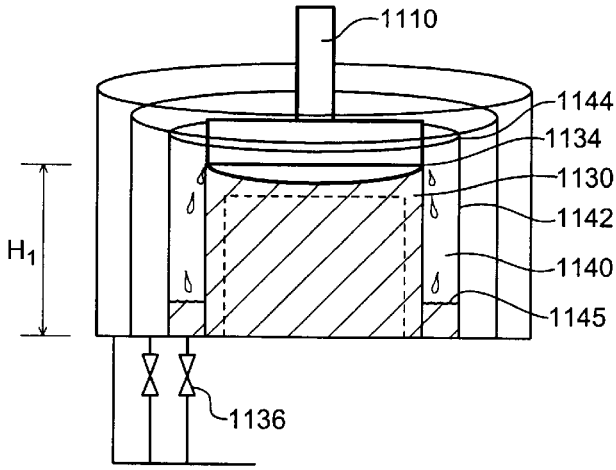
Figure 29:
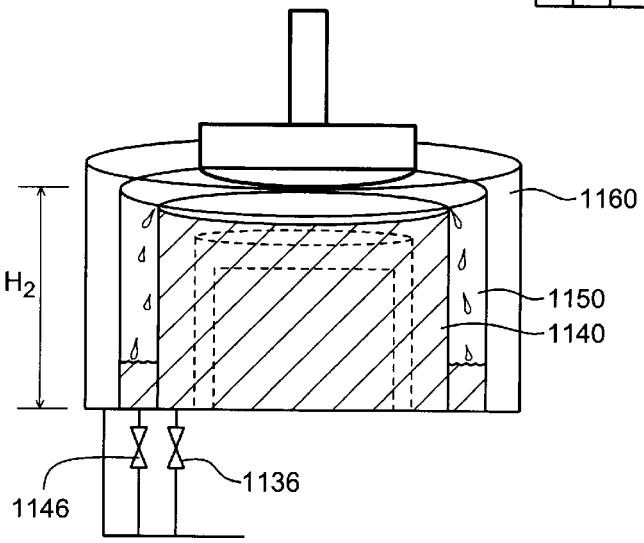

Preferred embodiments in accordance with the invention provide dynamic adjustment of bath height during electroplating and other electrochemical treatment operations. FIGS. 27–29 depict in schematic form an apparatus 1100 having a substrate holder 1110 for holding a wafer substrate, making electrical contacts to the wafer edge, rotating the wafer, and sealing the wafer edge and backside against plating fluid. An anode chamber 1120 is disposed in the bottom of a first bath container 1130 having cylindrical bath container wall 1132, which has a first container wall top 1134. A first control valve 1136 is fluidically connected to a concentric second container 1140 for controlling the flow of fluid out of first container 1130. Second container 1140 surrounds first container 1130. Plating fluid is typically pumped into anode chamber 1120 through an inlet manifold (not shown). As depicted in FIG. 28, first bath container 1130 is filled with plating fluid by filling the container with plating fluid until it overflows into second container 1140. The resistance of valve 1136 and associated drain lines is designed to be sufficiently small so that the fluid pressure created by the liquid head in container 1140 at a height 1145 lower than height 1134 creates a draining flowrate equal to that of the inlet flow into chamber 1130. First container wall 1132 functions as an overflow weir. The height of the plating bath is fixed at top 1134 of first bath container 1130, which effectively determines the substrate height. As depicted in FIG. 29, the height of the plating bath is increased by closing first outlet valve 1136, which causes plating fluid to accumulate in and fill second container 1140. The top 1144 of the second bath container wall 1142 is higher than the top 1134 of the first container, and determines the increment of increase of the bath height. Second bath container wall 1142 functions as an overflow weir as plating fluid overflows into concentric third container 1150, which surrounds second container 1140. Bath height is maintained by adjusting second outlet valve 1146 of third container 1150 so that the flow of spent plating fluid over the top 1144 of second container wall 1142 and through valve 1146 is substantially the same as the flow of fresh plating fluid into the anode chamber. The bath height is raised again in a similar fashion by repeating the process; that is, using valves to cause the third container 1150 to overflow into a fourth container 1160.

The height of substrate holder 1110 is typically adjustable by a vertical lift controller within a certain small range for any given bath height. For a fixed bath height, changes in vertical height (with respect to the anode) of a clamshell or other substrate holder must be kept small because of the various flooding and contamination phenomena discussed above. Beyond that range, however, the bath level must be changed. A relatively low plating bath height, $H_1$, as in FIG. 28, is useful in early stages of plating in which substantial amounts of shielding are desired to compensate for the thin film terminal effects. As plating progresses, the plated layer thickens, and terminal effects diminish. Then, it is desirable to increase the substrate height, moving the wafer away from the anode and diffuser shield, by raising the bath height to $H_2$ and raising the substrate holder, as in FIG. 29.

Figure 30:
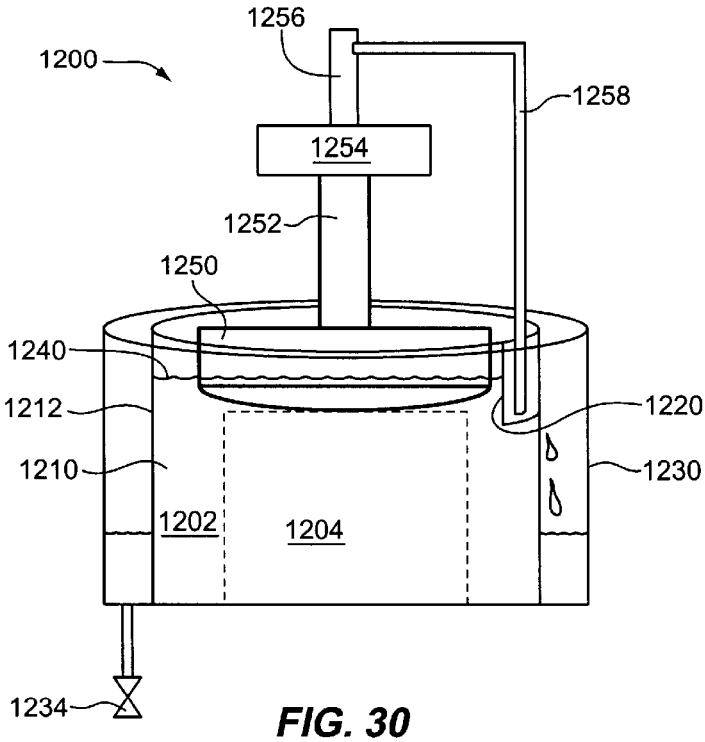
FIGS. 30–31 depict schematically an apparatus in accordance with the invention in which plating bath height is varied dynamically by selectively raising or lowering the sluice gate at the top of a bath container.
Figure 31:
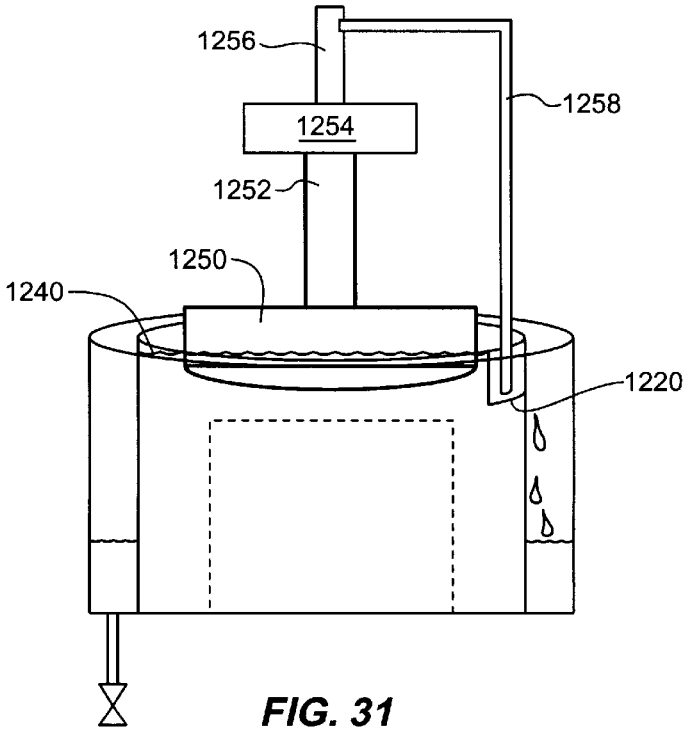

An alternative embodiment of a variable weir for varying bath height, and accordingly substrate height, is depicted in FIGS. 30–31. Plating bath 1202 and anode chamber 1204 are located in first container 1210 having cylindrical first container wall 1212. First container wall 1212 includes an adjustable gate 1220 through which a sluice of plating fluid flows into second container 1230. Outlet valve 1234 is opened so that spent fluid is sent out of second container 1230. Again, the system is designed such that liquid pressure and low drain resistance allow the height of the liquid in chamber 1230 to be maintained below variable height 1240 for all usable flowrates. The bath height 1240 of plating bath 1204 is adjusted by raising or lowering sluice gate 1220. For example, gate 1220 is raised in FIG. 31 compared to its level in FIG. 30. As a result, bath height 1240 is higher in FIG. 29 than in FIG. 30. As a result of increased bath height, substrate holder 1250 can be raised to a corresponding new substrate height, thereby increasing the distance between the treated surface of the wafer substrate and the anode (and diffuser shield, if present), while keeping the degree of immersion of the substrate holder in the liquid electrochemical bath relatively constant. In a particular embodiment of system 1200, a rotating shaft 1252 of substrate holder 1250 is connected to a rotation motor 1254. A vertical lift assembly 1256 does not rotate. A rigid support structure 1258 is operably connected to the vertical lift assembly 1256. Support structure 1258 controls the level of sluice gate 1220. An incremental change in the vertical height of substrate holder 1250 causes a corresponding incremental movement of lift assembly 1256 and, thereby, gate 1220. This enables direct coupling of the height of the substrate holder (substrate height) and the plating bath (bath height). The system also allows continuous variations of substrate height, rather than stepped changes.

It is evident that those skilled in the art may now make numerous uses and modifications of the specific embodiments described, without departing from the inventive concepts. For example, although embodiments were described herein with reference to the electroplating of 300 mm wafers, it is clear that embodiments in accordance with the invention are useful for 200 mm wafer and wafers larger than 300 mm. It is also evident that the steps recited may, in some instances, be performed in a different order; or equivalent structures and processes may be substituted for the structures and processes described. For example, embodiments in accordance with the invention also are useful in various electrochemical removal processes (e.g., electroetching, electropolishing, mixed electroless/electroremoval processing). In such applications, dynamic shielding and other measures for influencing electric fields are generally required at the end of film-removal process when electrical transport through the thinning metal film influences film removal at the wafer edge at a higher rate than at the wafer center. Since certain changes may be made in the above apparatus and methods without departing from the scope of the invention, it is intended that all subject matter contained in the above description or shown in the accompanying drawing be interpreted as illustrative and not in a limiting sense. Consequently, the invention is to be construed as embracing each and every novel feature and novel combination of features present in or inherently possessed by the systems, methods and compositions described in the claims below and by their equivalents.

What is claimed is:

1. An apparatus for electrochemically treating a surface of a substrate, comprising:

a substrate holder;

a plurality of dynamically operable concentric anodes opposite said substrate holder;

a diffuser shield located between said substrate holder and said concentric anodes; and an insert shield located between said diffuser shield and said substrate holder.

2. An apparatus as in claim 1, wherein:

said diffuser shield comprises an inside lip diameter in a range of about from 8 inches to 12 inches.

3. An apparatus as in claim 1, wherein:

said diffuser shield is a beta-type diffuser shield comprising wedge-shaped open areas in an annular lip.

4. An apparatus as in claim 1, wherein:

said insert shield comprises an inside diameter in a range of about from 10.5 to 12 inches.

5. An apparatus as in claim 1, wherein:

said insert shield and said substrate holder form a flow gap having a width in a range of about from 0.075 to 0.3 inches.

6. An apparatus as in claim 1, wherein:

said insert shield comprises a streamline-type rim portion.

7. An apparatus as in claim 1, wherein:

said insert shield comprises a modified streamline-type rim portion having a radius of curvature in a range of about from 1/16 to one-half inch.

8. An apparatus for electrochemically treating a surface of a substrate, comprising:

a first bath container configured to retain an electrochemical bath at a bath height;

a plurality of dynamically operable concentric anodes disposed in said first bath container;

a substrate holder disposed in said first bath container opposite said concentric anodes at a substrate height;

a shield disposed in said first bath container between said concentric anodes and said substrate holder, said shield configured for shielding a surface area of a substrate when a substrate is held in said substrate holder during electrochemical treatment operations; and a means, operable during electrochemical treatment operations, for dynamically varying a parameter selected from the group consisting of: a quantity of shielded surface area of a substrate, a distance separating said shield from said substrate holder, a distance separating said substrate holder from said concentric anodes, and combinations thereof.

9. An apparatus as in claim 8, comprising:

a variable weir assembly for dynamically varying said bath height; and an actuator for dynamically moving said substrate holder, to vary dynamically said substrate height.

10. An apparatus as in claim 9, wherein:

said first bath container has a first overflow height; and further comprising:

a second bath container surrounding said first bath container and having a second overflow height higher than said first overflow height; and a third, overflow container surrounding said second bath container.

11. An apparatus as in claim 10, further comprising:

a first valve for maintaining an electrochemical bath at said first overflow height; and a second valve for maintaining an electrochemical bath at said second overflow height.

12. An apparatus as in claim 9, wherein:

said first bath container comprises a bath container wall; and further comprising:

a movable sluice gate in said bath container wall for controlling said bath height.

13. An apparatus as in claim 8, wherein said shield is a diffuser shield located between said concentric anodes and said substrate holder.

14. An apparatus as in claim 13, wherein:

said diffuser shield comprises a plurality of rings rotatable about a common axis, each of said rings configured to have an open area and a closed area, and an actuator for dynamically rotating one of said rings to vary a quantity of shielded surface area of a substrate.

15. An apparatus as in claim 8, wherein said shield is an insert shield located between said anode and said substrate holder.

16. An apparatus as in claim 15, wherein:

said insert shield is separated from said substrate holder by a flow gap.

17. An apparatus as in claim 16, further comprising:

a movable spacer for attaching said insert shield to said substrate holder; and an actuator for moving said spacer to vary dynamically said flow gap.

18. An apparatus as in claim 8, further comprising:

means for rotating said substrate holder.

19. In an apparatus for electrochemically treating the surface of a substrate, comprising:

a bath container configured to retain an electrochemical bath having a bath height;

an anode disposed in said bath container;

a substrate holder opposite said anode and located at a substrate height;

a shield disposed between said anode and said substrate holder, said shield configured for shielding a surface area of a substrate when a substrate is held in said substrate holder; and a means, operable during electrochemical treatment operations, for dynamically varying a parameter selected from a group including a quantity of shielded surface area of a substrate, a distance separating said shield from a substrate in said substrate holder, a distance separating said substrate holder from said anode, and combinations thereof, the improvement characterized by said means being selected from the group consisting of:

a variable weir assembly for dynamically varying said bath height and an actuator for dynamically moving said substrate holder, to vary dynamically said substrate height;

a shield comprising a plurality of rings rotatable about a common axis, each of said rings configured to have an open area and a closed area, end an actuator for rotating one of said rings to vary a quantity of shielded surface area of said substrate; and a movable spacer for attaching a shield to said substrate holder and an actuator for moving said spacer to vary a distance separating said shield from said substrate.

20. A method for electrochemically treating the surface of a substrate, comprising steps of:

providing an electrochemical bath with a plurality of concentric anodes located at the bottom of said electrochemical bath;

placing a wafer substrate in a substrate holder, immersing said wafer substrate into said electrochemical bath at a substrate height and opposite said concentric anodes;

providing a diffuser shield located between said wafer substrate and said concentric anodes;

providing an insert shield located between said diffuser shield and said wafer substrate; and dynamically varying the power delivered to said concentric anodes.

21. A method as in claim 20, further comprising a step of:

pre-washing electric contacts located in said substrate holder before placing said wafer substrate in said substrate holder.

22. A method as in claim 20, further comprising a step of:

pre-wetting said wafer substrate before placing said wafer substrate in said substrate holder.

23. A method as in claim 20, further comprising a step of:

dynamically varying a flow gap between said insert and said substrate holder.

24. A method as in claim 20, further comprising a step of:

dynamically varying a closed area of said diffuser shield.

25. A method as in claim 20, further comprising steps of:

dynamically varying said bath height; and dynamically varying said substrate height.

26. A method for electrochemically treating a surface of a substrate, comprising steps of:

providing an electrochemical bath having a bath height in a first bath container, said first bath container containing a plurality of dynamically operable concentric anodes in a bottom portion of said first bath container, and further containing a shield located above said concentric anodes;

immersing a wafer substrate held in a substrate holder into said elecrtrochemical bath at a substrate height, such that said wafer substrate is opposite said concentric anodes and said shield is between said wafer substrate and said concentric anodes; and dynamically varying a parameter selected from the group consisting of:

a quantity of shielded surface area of said substrate, a distance separating said shield from said substrate, a distance separating said substrate from said concentric anodes, and combinations thereof.

27. A method as in claim 26, comprising steps of:

dynamically varying said bath height; and dynamically moving said substrate holder, to vary dynamically said substrate height.

28. A method as in claim 27, comprising steps of:

substantially closing a first outlet valve so that electrochemical fluid substantially fills a second bath container, thereby generating a second bath height; and controlling a second valve in a third container to maintain said second bath height.

29. A method as in claim 26, comprising a step of:

dynamically moving said substrate holder to vary said substrate height, thereby actuating a movable sluice gate in a bath container wall of said bath container for controlling said bath height.

30. A method as in claim 26, wherein said shield is a diffuser shield comprising a plurality of rings rotatable about a common axis, each of said rings configured to have an open area and a closed area, and said diffuser shield is located between said concentric anodes and said substrate holder, and further comprising a step of:

dynamically rotating one of said rings to vary a quantity of shielded surface area of a substrate.

31. A method as in claim 26, wherein said shield is an insert shield attached to said substrate holder by a movable spacer and located between said anode and said substrate holder, and further comprising steps of:

actuating said moveable spacer to vary dynamically a flow gap between said insert shield and said substrate holder.

32. A method as in claim 26, further comprising a step of:

pre-washing an electrical contact in said substrate holder before said step of immersing.

33. A method as in claim 26, further comprising a step of:

pre-wetting said wafer substrate before said step of immersing.

34. A method as in claim 26, further comprising:

rotating said substrate holder.

35. In a method for electrochemically treating the surface of a substrate, comprising steps of dynamically varying a parameter from a group including a quantity of shielded surface area of a substrate, a distance separating a shield from a substrate, a distance separating a substrate holder from an anode, and combinations thereof, the improvement comprising steps selected from the group consisting of:

dynamically varying a bath height, and dynamically moving a substrate holder, to vary dynamically a substrate height;

dynamically rotating a ring of a shield to vary a quantity of shielded surface area of a substrate, wherein said shield is a diffuser shield comprising a plurality of rings rotatable about a common axis, each of said rings configured to have an open area and a closed area; and actuating a movable spacer to vary dynamically a flow gap between an insert shield and a substrate holder.

36. A method as in claim 35, comprising steps of:

substantially closing a first outlet valve so that electrochemical fluid substantially fills a second bath container, thereby generating a second bath height; and controlling a second valve in a third container to maintain said second bath height.

37. A method as in claim 35, comprising a step of:

dynamically moving said substrate holder to vary said substrate height, thereby actuating a movable sluice gate in a bath container wall for controlling said bath height.

* * * * *